US005186037A

United States Patent [19]

Bihler

[11] Patent Number: 5,186,037

[45] Date of Patent: Feb. 16, 1993

[54] PROCESSING MACHINE, ESPECIALLY AUTOMATIC PUNCHING AND BENDING MACHINE

[76] Inventor: Otto Bihler, Schleiferweg 2, D-8959 Halblech/Füssen, Fed. Rep. of Germany

[21] Appl. No.: 664,924

[22] Filed: Mar. 5, 1991

[30] Foreign Application Priority Data

Mar. 7, 1990 [DE] Fed. Rep. of Germany ..... 4007204

[51] Int. Cl.[5] ..... B21D 11/07

[52] U.S. Cl. ..... 72/442; 72/404; 72/452; 72/472; 83/618; 100/291

[58] Field of Search ..... 72/404, 442, 446, 447, 72/448, 452, 472; 100/291; 83/618, 628; 140/105

[56] References Cited

U.S. PATENT DOCUMENTS

| | | | |
|---|---|---|---|
| 973,167 | 10/1910 | Caswell | 72/447 |
| 3,122,033 | 2/1964 | Riemenscheider et al. | 100/291 |
| 3,678,792 | 7/1972 | Dvorak | 100/291 |
| 4,444,227 | 4/1984 | Gott et al. | 140/105 |
| 4,580,329 | 4/1986 | Bihler | 83/618 |
| 4,696,178 | 9/1987 | Bihler et al. | 72/384 |
| 4,708,009 | 11/1987 | Post | 72/472 |
| 4,862,717 | 9/1989 | Dolliner | 72/447 |

FOREIGN PATENT DOCUMENTS

| | | | |
|---|---|---|---|
| 1279628 | 10/1968 | Fed. Rep. of Germany . | |
| 208662 | 11/1972 | Fed. Rep. of Germany . | |
| 317669 | 8/1974 | Fed. Rep. of Germany . | |
| 2625022 | 12/1976 | Fed. Rep. of Germany . | |
| 2926457 | 1/1981 | Fed. Rep. of Germany . | |
| 3312671 | 10/1984 | Fed. Rep. of Germany | 72/704 |
| 3447961 | 1/1987 | Fed. Rep. of Germany . | |
| 3205493 | 2/1988 | Fed. Rep. of Germany . | |

*Primary Examiner*—David Jones
*Attorney, Agent, or Firm*—Brumbaugh, Graves, Donohue & Raymond

[57] ABSTRACT

In a processing machine, for example an automatic punching and bending machine, it is proposed to drive a plurality of processing devices by a reciprocatingly moved drive rod, control cams being mounted on the drive rod and cam followers being mounted on moving parts of the processing devices.

42 Claims, 20 Drawing Sheets

PROCESSING MACHINE, ESPECIALLY AUTOMATIC PUNCHING AND BENDING MACHINE

BACKGROUND OF THE INVENTION

This invention relates to a processing machine, especially an automatic punching and bending machine, comprising a machine frame, a plurality of processing or machining units or a plurality of mounting positions for such units, mounted on the machine frame, and a drive means common to the plurality of processing units or some of them for driving at least one moved part of each of the processing units.

STATEMENT OF THE PRIOR ART

Such a processing machine is known from German Patent Specification 32 05 493.

In the known processing machine, the processing units are disposed on the front face of a processing plate. On the rear face of the processing plate, a worm shaft is disposed parallel to the processing plate. The processing units are distributed on the front face over the length of the worm shaft. Bores are provided in the processing plate, through which drive shafts for the individual processing units are pushed, so that worm wheels of these drive shafts come into engagement with the worm shaft. This known form of construction has proved satisfactory. It is suitable particularly for rapidly operating, highly accurate processing machines.

A certain disadvantage of the known processing machine lies in the fact that, by drilling the holes in the processing plate, the position of the processing units in the longitudinal direction of the worm shaft has been largely determined, and that within the framework of this fixing, a further adapting of the position of the processing units to the location of a specific processing position is restricted or is possible only at great expense.

The state of the art also includes a processing machine, in which a toothed belt is guided by belt pulleys on the rear face of the processing plate. In this processing machine also, the processing units are driven through holes of the processing plate by means of drive shafts, which engage by gear wheels into the toothed belt. This known processing machine appears to have the same disadvantage as the above-mentioned processing machine according to DE-PS 32 05 493, but in addition also the drawback that unavoidable stretching can occur in the toothed belt due to working loads and thus lead to uncontrollable phase displacement in the running of individual processing units.

OBJECT OF THE INVENTION

The objective of the present invention is so to construct a processing machine of the initially named class that the localizing constraint of the processing units shall be largely avoided and elastic deformations of the drive means under load shall also be avoided as far as possible.

SUMMARY OF THE INVENTION

A processing machine, especially automatic punching and bending machine, comprises a machine frame, a plurality of processing units mounted on the machine frame or a plurality of mounting positions for such processing units, and a drive means, common to the plurality of processing units or a portion of them, for driving at least one moving part of a respective processing unit.

The drive means comprise at least one drive rod unit, guided substantially linearly on the machine frame and reciprocating in oscillating manner in the guidance direction. One of the below-mentioned alternatives is fulfilled:

a) On said drive rod unit, a plurality of control cam elements or fixing positions for control cam elements are provided, which can be brought into engagement with cam followers for driving moving parts of processing units.

b) On the drive rod unit, a plurality of cam followers or fixing positions for cam followers are provided, which can be brought into engagement with control cam elements associated with the moving parts of processing units.

In the solution according to the present invention, the problem of mounting a drive shaft for connecting the processing units to the drive means disappears. The drive rod can be guided over its entire length or over the greater part of its length in the machine frame, so that bending forces on the drive rod cannot produce deformations. A longitudinal deformation of the drive rod under tensile and compressive forces can be readily avoided by appropriate cross-sectional design of the drive rod. In this connection it is desirable for the processing units and the drive of the drive rod to be so adapted to one another that the highest loadings of the drive rod preferably occur when the drive rod is being pulled by the drive connected in front of it. In pulling, the risk of deformation of the drive rod is smaller than in pushing, so that lower bearing friction in the linear guides of the drive rod can be expected. Furthermore, when operating in tension, the risk of buckling is avoided, which in turn could lead to increased friction in the guides.

With the construction according to this invention, it is readily made possible for the drive rod and the processing units to be disposed on one and the same side of a processing plate, because the drive rod, in contrast to a worm shaft or toothed belt, occupies less space and in particular the guide means for the drive rod require little space. The guide rod can, for example and by preference, be largely recessed into a guide groove of a processing plate. If, however, the drive rod and the drive unit are situated on one and the same side of the processing plate, then the need for providing the processing plate with bores for passing through the drive power from the drive rod to the processing units is dispensed with, and thus also the rigid positioning of the processing units imposed by such bores is also eliminated. Instead, it becomes possible to adjust the processing units infinitely variably or by very fine steps along the drive rod and to mount the control cams or cam followers, as the case may be, on the drive rod at the location where the optimum position for the processing unit in regard to its task is situated. With such a solution, it is of course possible as in the state of the art to mount the processing units on a processing plate at an angle other than 90° to the oscillating direction of the drive rod. However, the oblique position of the processing units frequently employed in the state of the art for achieving specific machining locations can often be dispensed with in the solution according to this invention, if the oblique position is considered not in respect of the direction of machining but only in respect of the choice of machining location, because with the solution of this invention the choice of machining location is readily possible by infinitely adjustable or finely adjustable positioning of the processing units.

The positioning of the processing or machining units can, in the solution of this invention, be provided by fixing grooves for these processing units on the relevant side of the processing plate and/or by a close array of positioning means, such as positioning bores or serrations which are capable of accepting the rod forces. An inclined position of the processing units is certainly not, of course, excluded in the solution of this invention.

The control cams can be formed on the drive rod in one piece with it. It is preferred, however, to provide for the control cam elements or cam followers to be adjustable infinitely or by fine steps on the relevant drive rod and able to be fixed to it, and for the processing units to be adjustable by fine steps or infinitely on the machine frame, longitudinally and possibly also transversely to the drive rod, and able to be fixed to the frame.

The oscillating frequency and/or oscillation stroke and/or the oscillation pattern of the drive rod may be variable, in order to allow a wide variety of processing tasks to be fulfilled. This is true particularly when several drive rods are present, in which case corresponding changes for each individual one of these drive rods are possible.

For driving the drive rods, various possibilities are available. Thus, it is possible for the drive rod to be driven by an eccentric drive with optionally variable eccentricity and/or variable rotational speed.

It is also possible for the drive rod to be driven by a cam drive, the shapes of cam being variable. By superimposing specific cam shapes of a cam drive which drives the drive rod and specific cam shapes of the control cam elements mounted on the drive rod or on the relevant processing unit, interesting movement sequences of the processing unit can be obtained, which would not readily be available if cams were variable at one position only. In particular, by such superpositioning, movement shapes can be obtained at the processing unit which cannot be achieved with one single, conventional sinusoidal curve, but by the superimposing of two sinusoidal curves.

It is furthermore possible for the drive rod to be driven by a worm drive with reversing drive motor.

The reversing drive motor can then be programme-controlled in respect of its particular set position and/or set speed, so that similar effects can be obtained as by varying a drive curve of a cam drive which drives the drive rod.

The drive rod can, furthermore, be driven by a step-up gear with variable gear ratio, especially by a lever gear with variable transmission ratio.

The term "processing units" (or "machining units") is to be understood in the broadest sense and comprises, for instance, sub-assemblies on an assembling machine or packing machine. Furthermore, the drive of auxiliary devices of a processing machine can be derived from a drive rod, for example the drive of material feed devices and/or workpiece transport devices.

Where several drive rods are present, the possibility exists of driving them from a common drive shaft, if desired via different step-up gears with variable transmission ratios.

The invention can be realized with a wide variety of forms of machine frame. For example, it is possible for two basically mutually parallel drive rods to be mounted on one principal working plane of the machine frame, for a workpiece processing zone to be provided between these drive rods, and for processing units to be associated with each drive rod, the moving parts of which units are movable to and fro, approximately towards the processing zone.

It is furthermore possible for two mutually substantially parallel processing planes, spaced apart from each other, to be formed on the machine frame, for at least one drive rod to be associated with each of these processing planes, these drive rods being essentially parallel to one another, and for the machine frame to possess a workpiece passage which connects together the two processing planes. In this latter form of embodiment, workpieces may, for example, first be processed on a first processing plane or level, and then conveyed through the workpiece passage to the second processing plane or level and then processed in this second processing plane, the term "processing" being used here again in the above-defined wide sense.

If a passage between two processing planes is present, it is possible for transverse transporting means to be provided in the passage in order to transfer workpieces from the one to the other processing plane, these transporting means preferably being driven by a drive rod oscillating in its longitudinal direction.

A further possibility of carrying out different types of processing consists in that several, especially two, mutually parallel drive rods are disposed alongside one another perpendicularly to the processing plane in front of this plane. With such a constructions, successive processing units can be brought together in an extremely small spacing and also, in certain circumstances, disposed above or overlapping one another, because the longitudinal extent of the control cams is no longer determining for the spacing between adjacent processing units. In this manner, for example, holding-down devices and processing tools on machines for bending wire or strip can be accommodated in a very confined space without difficulty. The use of two mutually parallel, individually driven drive rods offers the advantage that they can have different strokes and different oscillating frequencies and execute different movement sequences. The advantage of closer proximity and if necessary overlap between adjacent processing units can be achieved also by a drive rod, which has two longitudinal zones alongside one another perpendicularly to the processing plane for the forming of control cams or the mounting of control cam elements, being disposed in front of a processing plane of the machine frame, although in this case however the possibility of different movement sequences of the individual longitudinal zones does not exist. The drive rod or rods can, for drive transmission to the processing units mounted on the processing plane, advantageously be disposed also on a support component of the machine frame cantilevered forwardly over the processing plane. The possibility is then offered also of providing journalling facilities for shift levers on a front face of the support component essentially parallel to the processing plane, which levers, on the one hand, are each in engagement with a control cam on a drive rod and, on the other hand, act upon a moving component of the processing unit.

In the construction according to this invention it is conceivable to construct the moving part of a processing unit directly with a cam follower which is in engagement with the control cam element of a drive rod, or vice versa. It is also possible, however, for the moving part of a processing unit to be formed by a slider, which is guided linearly on a slide guide of the processing unit, especially approximately perpendicularly to the longitudinal extent of the drive rod, and for this slider to be in driving connection with a pivoting lever, pivotally journalled on the slide guide or machine frame, which receives a pivoting movement from a drive rod and transmits it to the slider. With this form of construction, transverse forces on the slide guide are largely avoided. The transverse forces that arise in cooperation between control cam and cam follower are then accepted by the bearing of the pivoting lever. This pivoting lever should extend substantially perpendicularly to the direction of movement of the slider and parallel to the direction of movement of the drive rod. Especially favourable load conditions arise if an engagement position between the pivoting lever and the drive rod and an engagement position between the pivoting lever and the slider are approximately aligned with one another, with a direction of alignment substantially parallel to the direction of movement of the slider.

In various processing machines, e.g. in punching and bending machines, the danger exists on occasions that a moving tool may jam at the processing position and cannot be pulled back. In this connection, a precaution can be taken, where a pivoting lever is present, in that an engagement connection between the pivoting lever and the slider is created by a spring force that prestresses the slider against the pivoting lever, and that at the position of this engagement connection a sensor is provided, which detects any separation between the slider and pivoting lever and, if such a separation is detected, supplies a stopping signal for the processing machine.

Simple processing operations can frequently be carried out also by rectilinear control cams. In particular this is true when the possibility exists of varying the angle of the rectilinear control cams relative to the oscillation direction of the drive rod. It is therefore further proposed that the control cam element shall have a rectilinear control cam and that the angular setting of this control cam relative to the direction of oscillation of the drive rod shall be variable and able to be fixed.

A common problem on processing machines is to execute a change-over to different processing tasks with short change-over times. For the solution to this problem, the processing machine of the present invention is particularly suitable or at any rate can be readily made suitable, in that the drive rod, together with the cams and control cam elements mounted on it, is interchangeable as a unit, that position recording means are provided for recording specific, once adjusted positions of the processing units, and that position indicating means are provided on the processing machine which allow a processing unit, that has been taken from a once adjusted position, to be fitted at a later time, by means of the position record, back into the initially set position on the processing machine.

In order to make available, for the processing or working stroke of the processing units, the greatest possible fraction of the total time available for a processing cycle of the processing units, it is proposed that a drive rod unit shall be driven more slowly in a direction of movement that corresponds to the working stroke of associated processing units than in a direction of movement that corresponds to the return stroke of the associated processing units.

To make a drive rod unit that extends over a great length more easy to manufacture, it is proposed that a drive rod unit shall consist of a plurality of drive rod unit portions essentially aligned with one another, which are connected together in the longitudinal direction of the drive rod units for common movement. This opens up also the possibility of imparting to individual portions of the drive rod unit different transverse movements, transversely to the longitudinal extent of the drive rod unit.

To make possible an easily produced guide for the drive rod unit or a part thereof, it is proposed that at least a portion of a drive rod unit shall be guided by guide links in the manner of an articulated parallelogram. This manner of guidance does indeed impose a certain transverse motion on the relevant drive rod portion. This transverse motion may, possibly, alone be used for obtaining the working stroke of associated processing units, by the associated cams being formed linear and parallel to the longitudinal movement of the drive rod unit. It is also possible, however, to construct the cams with any non-linear profile and, in calculating the profile, to take into account the transverse motion of the control rod portion, in such a manner that the desired movement sequence of the processing units is obtained.

In order to make possible processing or machining with a larger number of processing or machining directions, it is proposed that in at least one processing plane, a plurality of drive rod units shall be disposed along a polygon which surrounds a processing or machining zone.

In order to make the processing machine suitable for assembly purposes, it is to be recommended that at least some of the processing units and the associated drive rod units shall be disposed in a horizontal processing plane.

To enable the workpieces, even when they are not connected together in the manner of wires or strips, to be conveyed through various processing stations, it is proposed that a conveying means be provided on the machine frame, for conveying workpieces to be processed step-by-step through various processing stations.

The various features of novelty which characterize the invention are pointed out with particularity in the claims annexed to and forming a part of the disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

The attached figures explain the invention by reference to examples of embodiment thereof. The figures show.

DETAILED DESCRIPTION OF THE PREFERRED EMBODIMENTS

Figure 1:
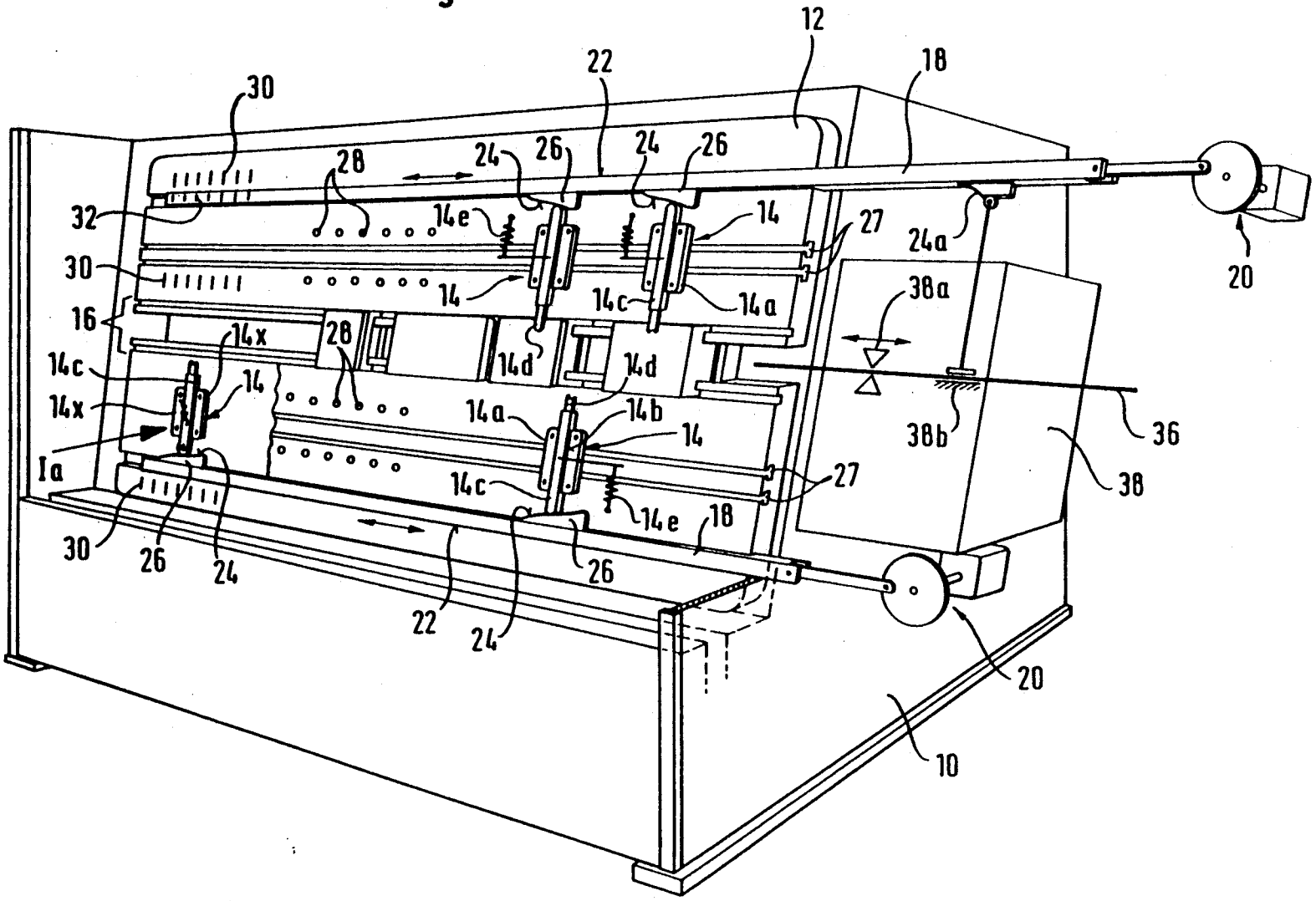
FIG. 1 a front view of a processing machine according to this invention.

In FIG. 1, reference 10 denotes a machine frame. This machine frame possesses a processing plate 12, on the front face of which a plurality of processing units 14 are mounted. These processing units 14 are intended and are suitable for processing workpieces in a processing zone 16 from above and from below, possibly also with a processing direction orientated obliquely to the vertical.

Each processing unit consists of a body 14*a* comprising a slide guide 14*b*, a carriage 14*c* and a tool 14*d*. The processing units of each row of processing units are driven by one drive rod 18. The drive rods 18 are each driven by an oscillating drive 20 and are linearly guided each in a guide groove 22 of the processing plate 12. For each processing unit, a control cam 24 is mounted on the associated drive rod 18, and this cam acts on the associated carriage 14*c* and displaces the latter towards the processing or machining zone 16, while the restoring movement of the carriage is effected in each case by a restoring spring 14*e*.

The control cams 24 are formed on control cam elements 26, which are adjustable and able to be fixed longitudinally of the drive rods 18. The bodies 14*a* of the processing units 14 can be secured in T-grooves 27 and in arrays of fixing bores 28 by means of fixing pins, it being possible for positioning pins to be introduced into the fixing bores 28 and to engage also into the bores of the body 14*a*. It is also conceivable to position the bodies 14*a* on the processing plate 12 by mutually engaging sets of teeth and additional fixing means, which then assure mutual engagement of the sets of teeth. On the front plate, positioning scales 30 are fitted, which enable the bodies 14*a*, once they have been removed from the processing plate 12, to be fitted again into a position recorded in a list or computer, without renewed empirical determination being necessary. The control cam elements 26 may also be mounted by positioning scales 32 in reproduceable positions on the relevant drive rods. The possibility furthermore exists of removing the drive rods, together with the control cam elements 26 as complete units, and replacing them again. Thus it is possible rapidly to modify the machine for various processing tasks, on the one hand by replacing the drive rods 18 together with control cam elements 26 mounted thereon as one complete unit and, on the other hand, by bringing the processing units 14 by means of the positioning scales 30 into the positions corresponding to the particular processing task. The tools 14*d*, also, may remain on the guide carriages 14*c*, if processing units are available in sufficient numbers.

The example illustrated relates to an automatic punching and bending machine, which makes workpieces from a wire or strip material 36. The feed of the wire or strip material is provided by a feed device 38 having a movable clamping point 38*a* and stationary clamping point 38*b*. In the example illustrated, the stationary clamping point 38*b* is controlled by a cam 24*a* of the drive rod 18. It is also conceivable to control the moving clamping point 38*a* from one of the drive rods 18.

In FIG. 1 it is indicated at Ia that a carriage 14*c* can be guided also directly on the processing plate, such as by strips 14*x*, which are screwed to the processing plate 12 or made integrally with the processing plate. On the carriage 14*c*, a tool 14*d* is mounted. It would also be possible for the tool 14*d* to be guided directly in the strips 14*x*.

Figure 1A:
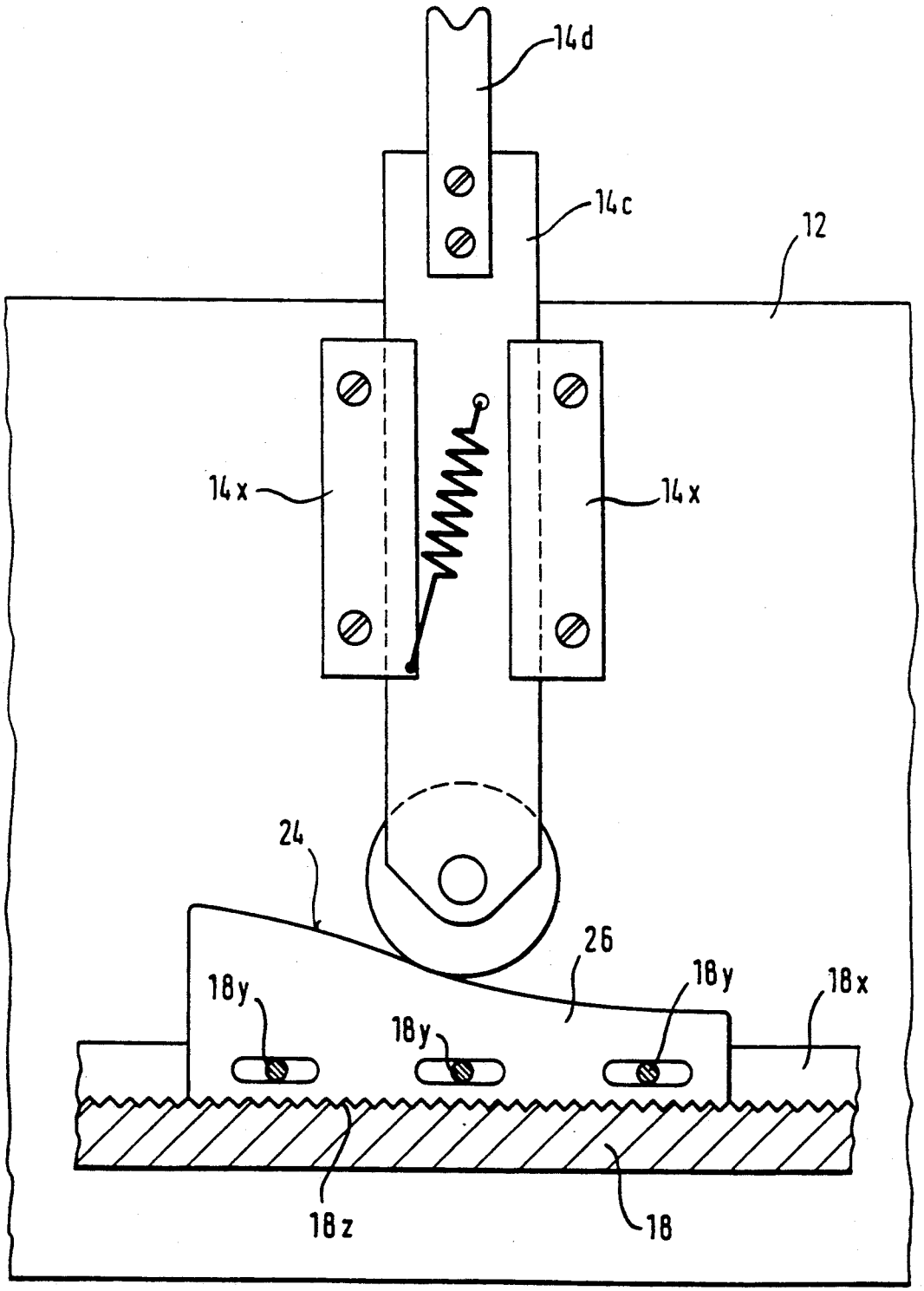
FIG. 1*a* a detail at Ia of FIG. 1.

The control cam element 26 is, in the present case as shown in FIG. 1*a*, fixed to the drive rod 18, being secured in a groove 18*x* by screws 18*y*. A set of fine teeth 18*z* positions the control cam element 26 longitudinally of the drive rod 18 and transfers the longitudinal forces. The screws 18*y* pass through elongate holes of the control cam elements 26, the length of the holes being equal to at least twice the tooth pitch.

Figure 2:
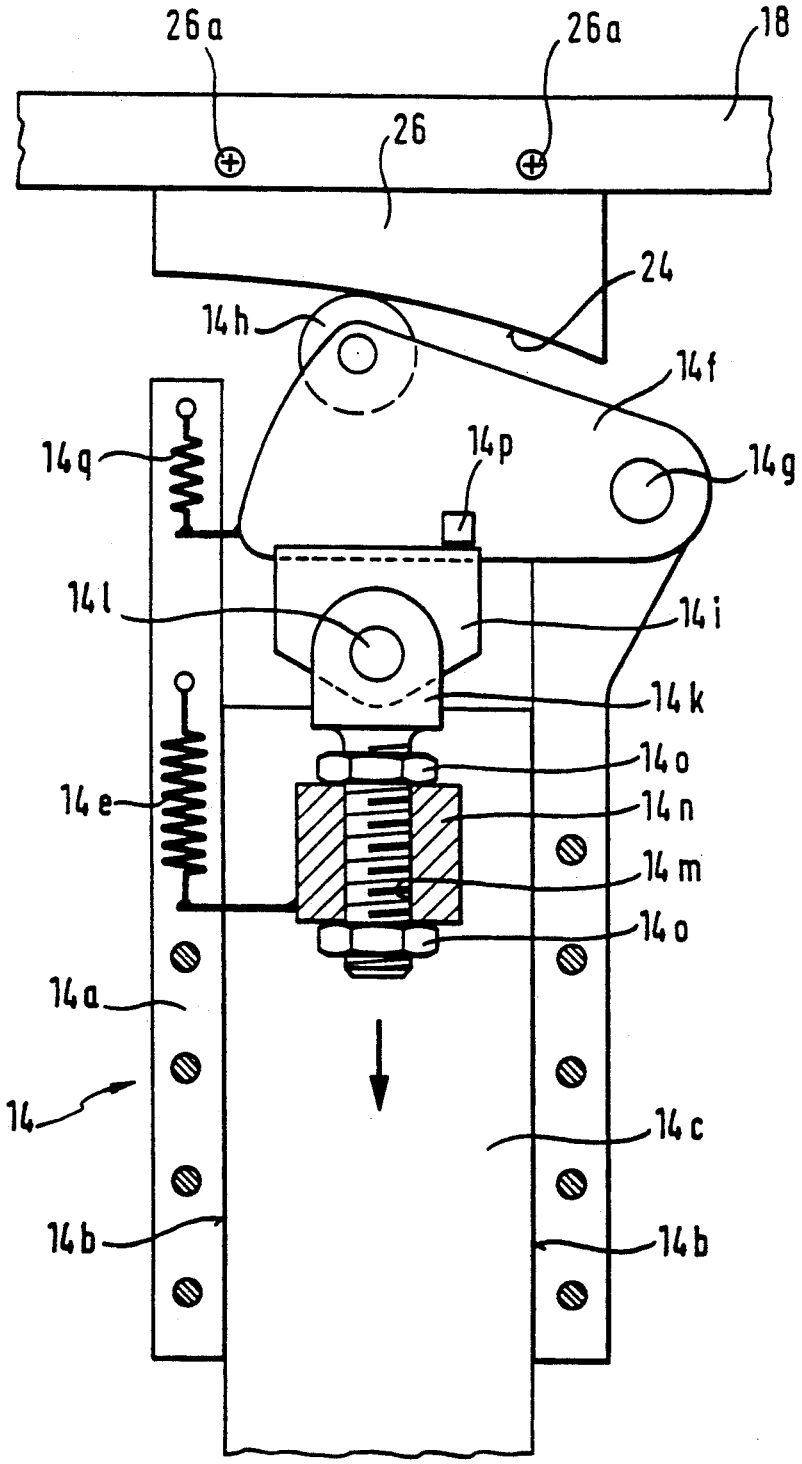
FIG. 2 a processing unit on a processing machine of this invention.

In FIG. 2, a processing or machining unit 14 is shown in detail. Here can be seen the body 14*a* together with the slide guide 14*b*, in which the sliding carriage 14*c* is guided. The carriage 14*c* is prestressed towards the drive rod 18 by a spring, especially a helical tension spring or helical compression spring 14*e*. On body 14*a*, a pivoting lever 14*f* is pivotally journalled about a pivot pin 14*g*. This pivoting lever 14*f* carries a cam follower roller 14*h*, which is in engagement with a control cam 24 of the control cam element 26. On the pivoting lever 14*f*, a sliding shoe 14*i* is guided. This sliding shoe 14*i* is pivotally connected by a connecting pin 14*l* with a joint pin 14*k*. The joint pin 14*k* engages, by its external thread 14*m*, adjustably into a threaded bore of a projection 14n of the carriage 14c and is secured by securing nuts 14o.

The sliding shoe 14i can be lifted off the pivoting lever 14f. Any such lift-off can be detected by a lift-off sensor 14p.

If the drive rod 18 in FIG. 2 moves to the left, the carriage 14c is displaced downwards by engagement of the cam follower into the cam 24, while if the drive rod 18 mvoes to the right the helical tension spring 14e ensures return of the carriage 14c upwards. The pivoting lever 14f is subject to the action of a further helical tension spring 14q, which always attempts to hold the cam follower roller 14b in engagement with the cam 24.

If the tool of the carriage 14c should jam in the machining position and the spring force of the helical spring 14e be insufficient to release this jamming, then the pivoting lever 14f lifts off the sliding shoe 14i and the lift-off sensor 14p supplies a lift-off signal, which can trigger a shutdown of the entire machine, so that damage to the machine due to the jamming cannot occur.

It should be noted that reaction forces resulting from the engagement of the cam follower roller 14h with the control cam 24 are accepted parallel to the drive rod 18 by the bearing pin 14g and are therefore not transmitted into the carriage. It should furthermore be noted that the cam follower roller 14h and the connecting pin 14l are aligned with one another along a direction of alignment substantially perpendicular to the direction of movement of the drive rod 18.

Figure 2A:
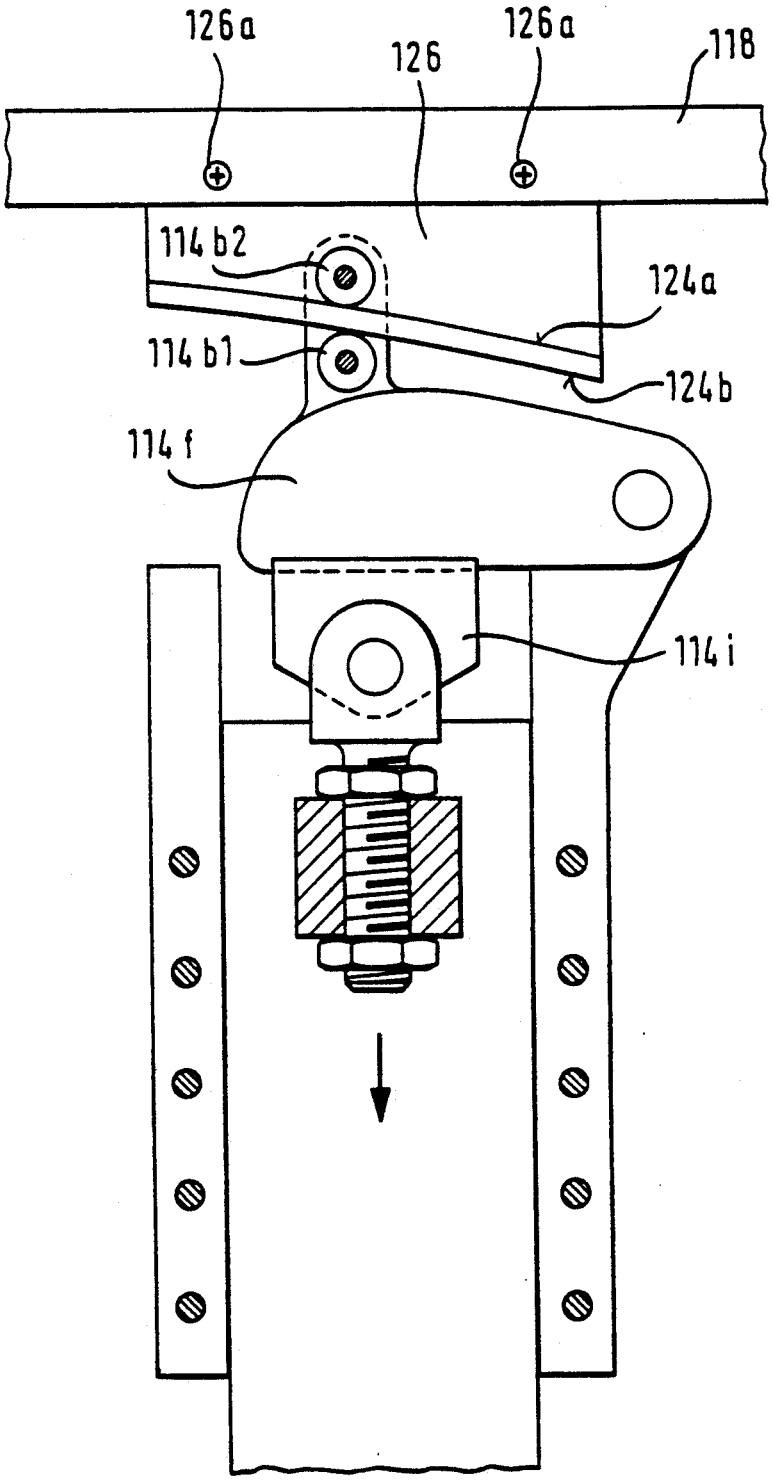
FIG. 2*a* a first variant of FIG. 2.

In FIG. 2a, a variant from FIG. 2 is illustrated. As a difference from FIG. 2, the control cam element 126 is constructed with two control cams 124a and 124b, and two cam follower rollers 114b1 and 114b2 are mounted on the pivoting lever 114f. In this form of embodiment, at least the helical tension spring 14q of FIG. 2 can be dispensed with, possibly also the helical tension spring 14e, if the sliding shoe 114i is connected with the pivoting lever 114f by overlap engagement, to prevent lift-off.

In both forms of embodiment of FIG. 2 and FIG. 2a, the control cam element 26, 126 respectively is firmly clamped to the drive rod 18, 118 respectively, as indicated by clamping screws 26a, 126a respectively.

Figure 2B:
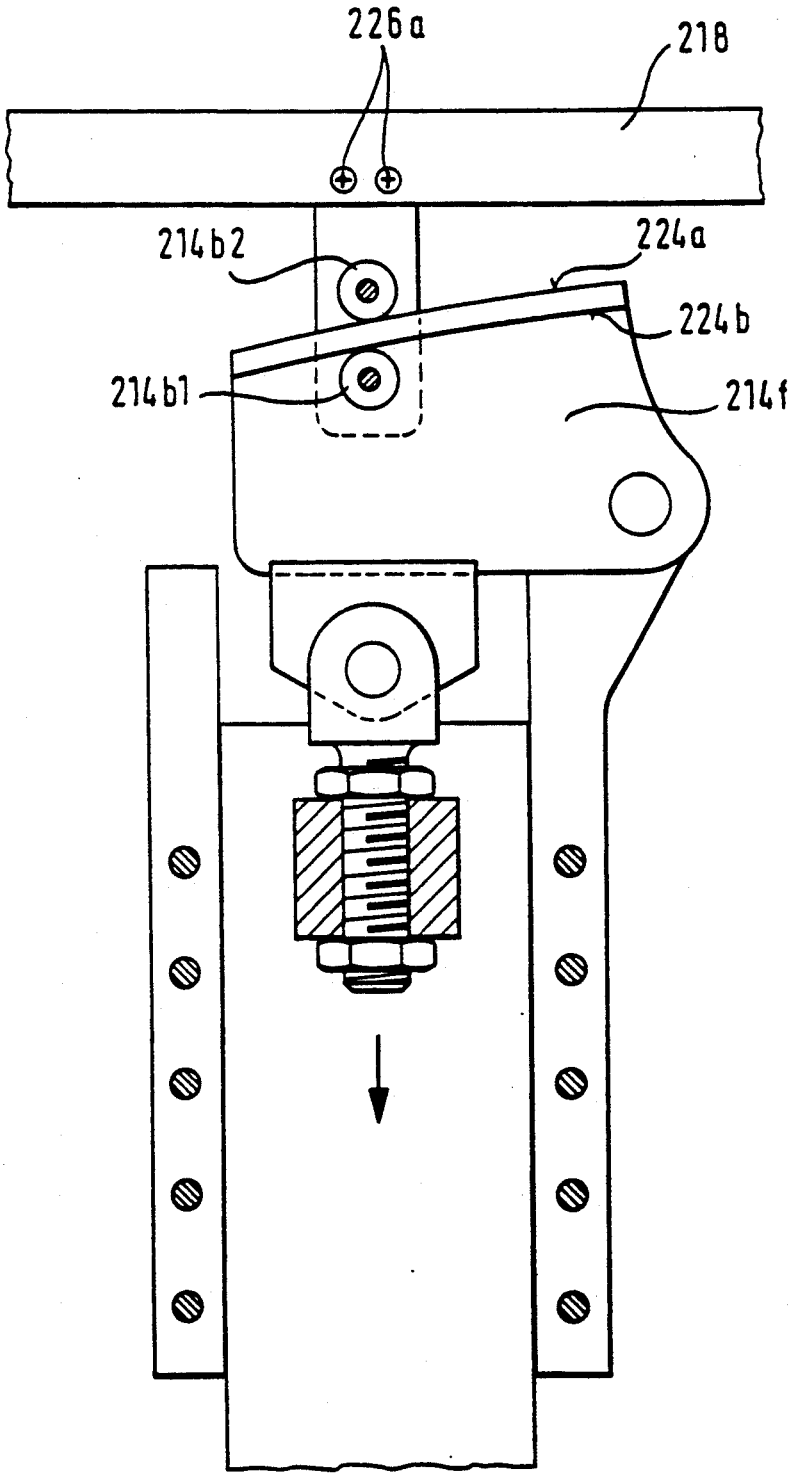
FIG. 2*b* a further variant of FIG. 2.

The embodiment of FIG. 2b differs from those of FIGS. 2 and 2a especially in that two control cams 224a and 224b are mounted on the pivoting lever 214f, whereas two cam followers 214b1 and 214b2 are mounted adjustably and capable of being fixed by clamping screws 226a on the drive rod 218.

It can be seen in FIG. 2 that the drive rod 18 is most heavily loaded when it is moving towards the left and pushing the slide 14c downwards, so that the tool mounted on the slide 14c is carrying out a punching or bending operation. Accordingly, if possible, the rod 18 in FIG. 2 is operated as a pulling rod towards the left, so that no buckling forces can be introduced into the drive rod 18, which could lead to loading of the linear guide 22 (FIG. 1). If several processing or machining units are connected to one drive rod, then the aim will be so to arrange the control cams that in the majority of the processing units the maximum processing or machining forces occur when the drive rod 18 is being pulled by its drive (see 20 in FIG. 1). This will not be possible in all cases. Even when compressive forces occur in the drive rods, there is no risk of distortion, because the drive rods 18 are guided over a substantial portion of their length in the linear guides 22.

Figure 3:
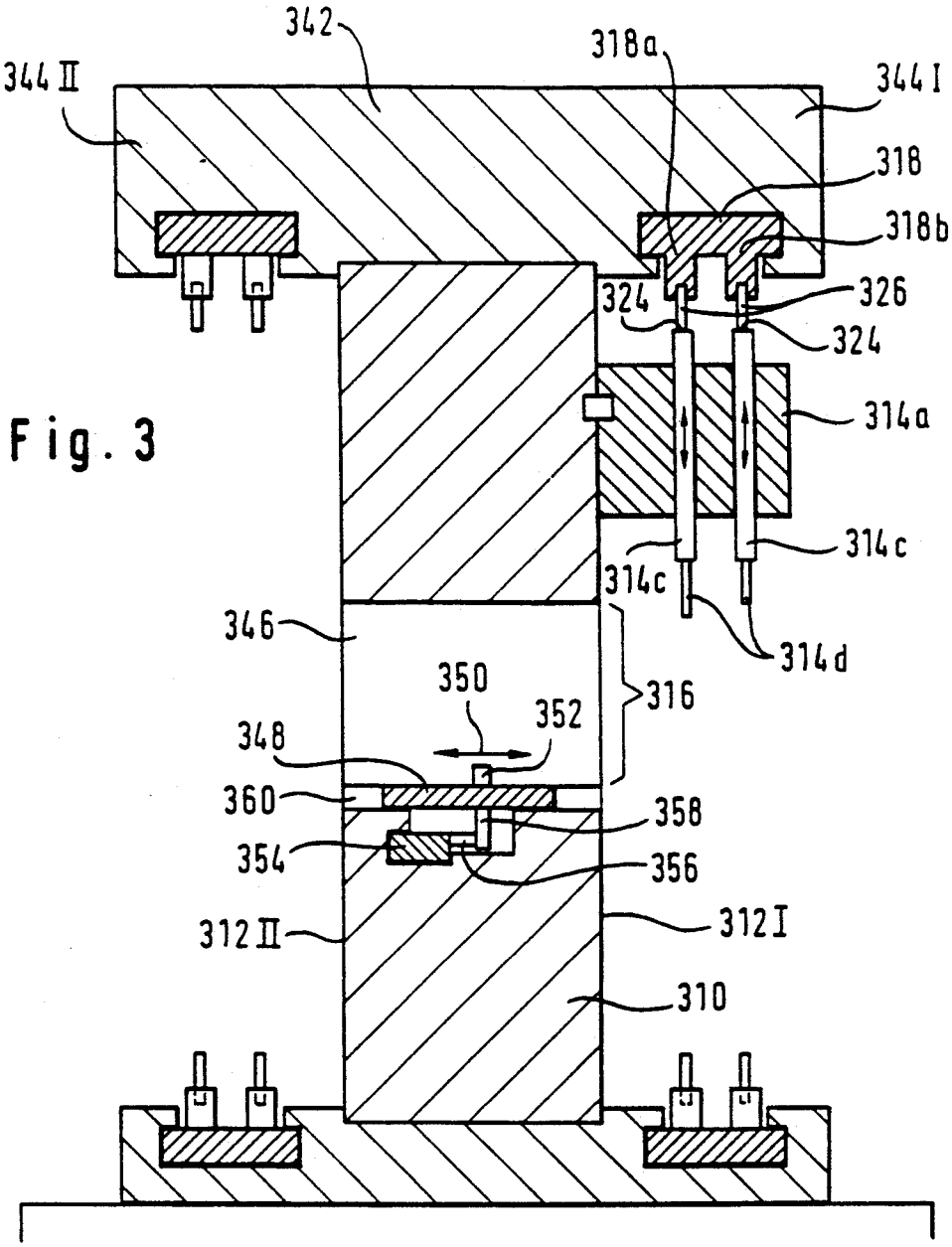
FIG. 3 a further form of embodiment of a processing machine according to this invention.

In FIG. 3, there is shown a machine frame, which is referenced 310 and possesses two principal processing planes 312I, 312II. The machine frame 310 possesses a saddle 342, which has, above each of the principal processing planes 312I and 312II, a cantilevered beam portion 344I and 344II. In the cantilevered beam portion 344I, a drive rod 318 can be seen, which has, alongside each other, two longitudinal zones 318a and 318b for the mounting of control cam elements 326. The control cam elements 326 are in engagement with carriages 314c, on which processing tools 314d are mounted. The drive of the carriage 314c may be effected similarly to that shown in FIG. 2. An interesting feature of this form of embodiment is that, as a result of the association alongside each other of two rows of control cam elements 326 (alongside one another in a direction perpendicularly to the principal processing plane 312I!), the carriages 314c can be arranged above one another in front of the principal processing plane 312I, for example by being guided in one common body 314a. In this manner it becomes possible to accommodate two carriages 314c at the closest possible spacing opposite a processing station, without allowance having to be made for the spatial requirement of the control cam elements 326 in the longitudinal direction of the drive rod 318. It can be imagined, for example, that one of the processing tools 314d is a holding-down device and the other a bending or punching stamp. In this way holding-down member and bending or punching stamp can be brought to the closest possible spacing together, as is desired.

The arrangement in FIG. 3 has been chosen similarly to that in FIG. 1 in so far as in FIG. 3 also, two groups of processing units can be associated with each of the processing planes 312I and 312II, these processing units operating from above and from below towards the processing zone 316.

The machine frame 310 is traversed by a passage 346, through which the workpieces to be processed can be conveyed between the two processing planes 312I and 312II. Conveying can be assured by a transport carriage 348, which moves to and fro in the direction of arrow 350 and has an entraining dog 352.

The drive of the transport carriage 348, in turn, can be provided by a drive rod 354 having control cam elements 356, which act upon a cam follower 358 of the transport carriage 348. The transport carriage 348 is guided in a recessed guide groove 360 of the lower boundary surface of the passage 346.

Figure 3A:
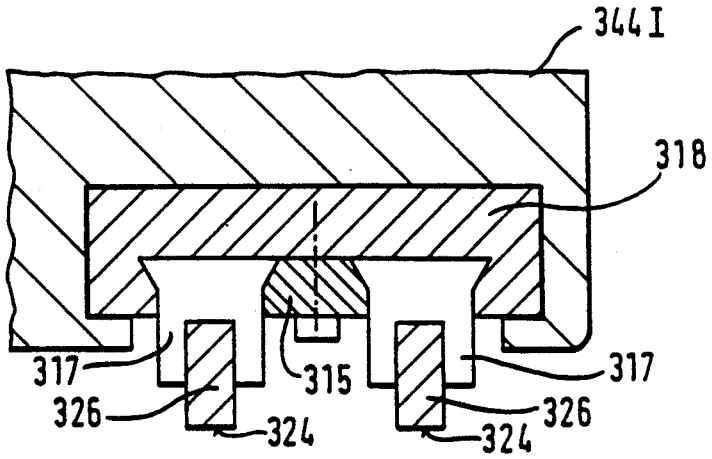
FIG. 3*a* the drive rods on the processing machine according to FIG. 3.

In FIG. 3a, a further detail of FIG. 3 is illustrated. Here again the drive rod 318 can be seen. In this drive rod 318, two clamping strips 317 are clamped, by means of a strip-shaped clamping piece 315. Each of the clamping strips 317 seats control cam elements 326 having control cams 324, which can be clamped to the strip.

Figure 4:
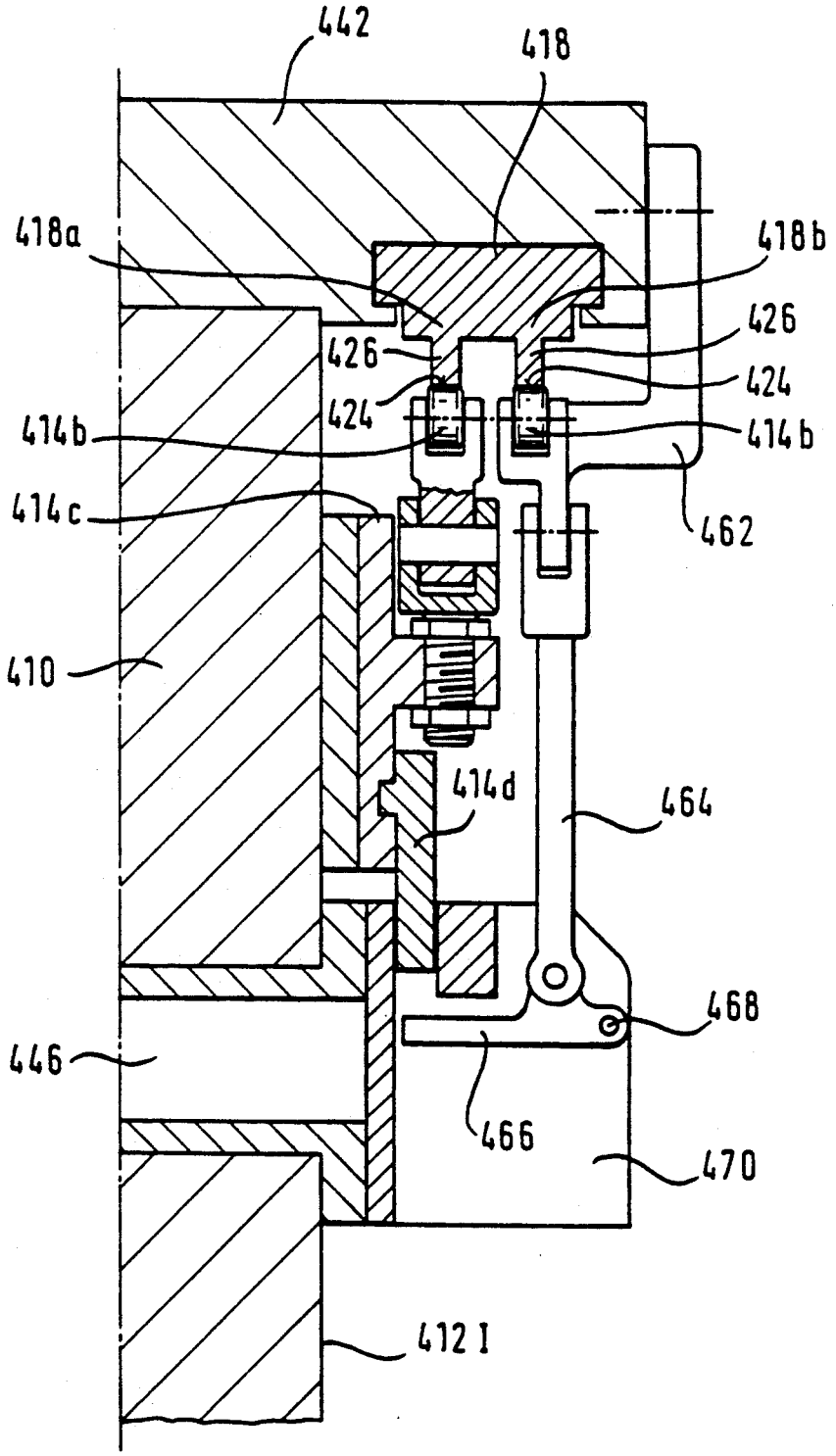
FIG. 4 a variant of FIG. 3.

The arrangement of FIG. 4 corresponds basically to that of FIG. 3. Like components have like references, increased in each case by 100. The control cam element of the longitudinal zone 418a on the drive rod 418 acts in the present case on a guide carriage 414c, which carries a tool 414d. The carriage is constructed in the manner shown in FIG. 2. The control cam element of the longitudinal zone 418b acts upon a pivoting lever 462, which in turn acts via a connecting rod 464 on a processing lever 466. This processing lever 466 is journalled at 468 on a support member 470 for the workpiece to be processed. The processing tool 414d and processing lever 466 both act upon the workpiece to be processed.

Figure 5:
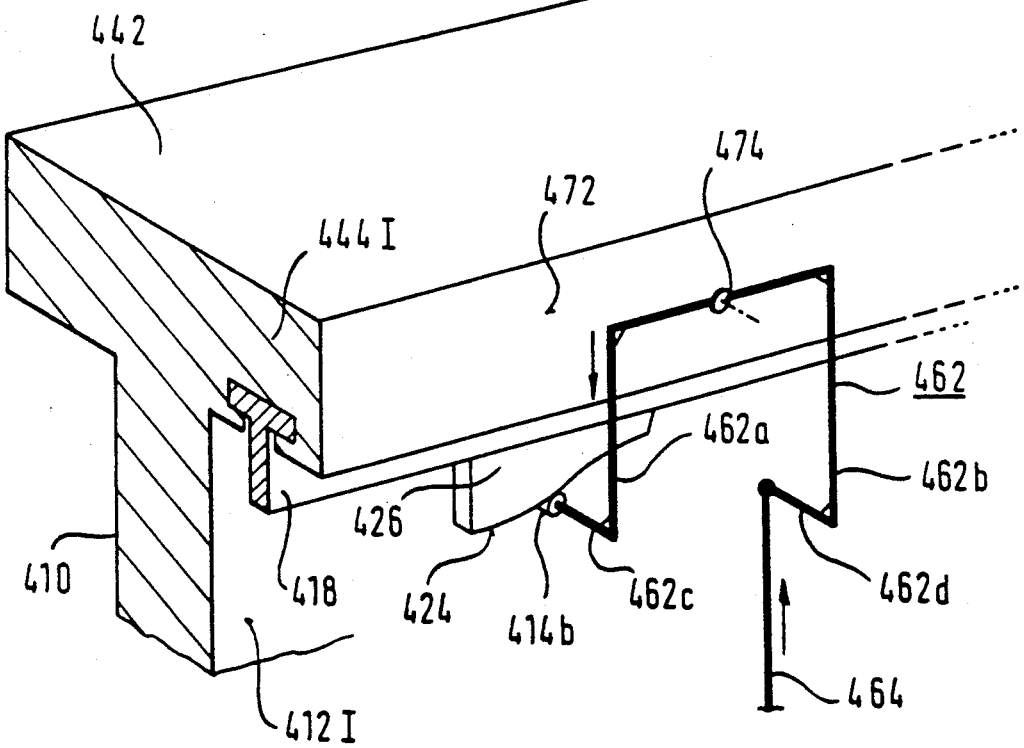
FIG. 5 a perspective schematic view of FIG. 4.

In FIG. 5, a pivoting lever 462 is schematically illustrated. It is pivotally journalled on a front face 472, parallel to the principal processing plane 412I, at a pivot 474 and engages with its one arm 462*a* on the cam 424 of the drive rod 418, while with its other lever arm 462*b* it acts upon the connecting rod 464. It can be seen from the movement arrows that a downward movement of the lever arm 462*a* results in an upward movement of the lever arm 462*b*. This inverting of the movement can be advantageous for various processing tasks. It is also possible to see the cranks 462*c* and 462*d* on the lever arms 462*a*, 462*b* respectively. By these cranked zones, the processing positions for the workpiece can be displaced independently of the position of the drive rod 418 into different planes parallel to the principal processing plane 412I.

Figure 5A:
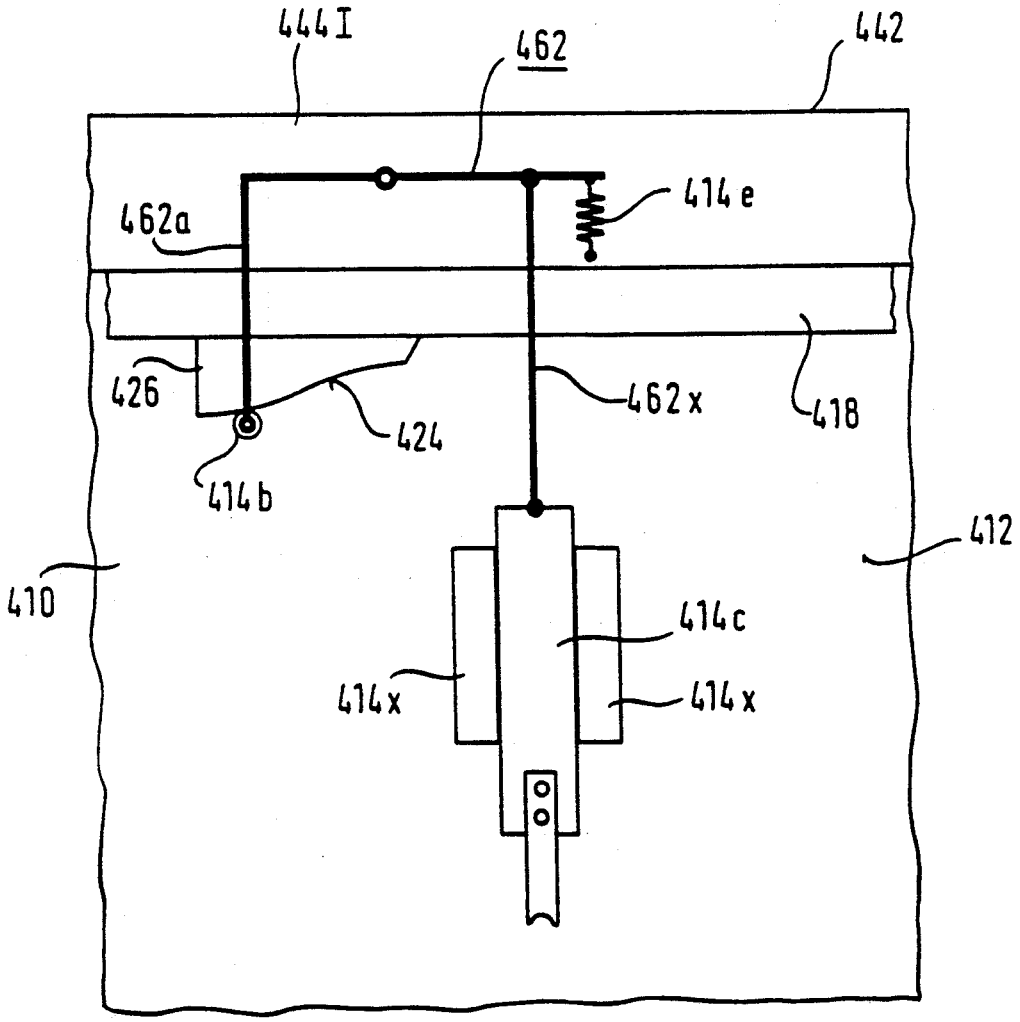
FIG. 5*a* a front elevation of FIG. 5.

In FIG. 5*a*, a rod 462*x* is articulated to the lever 462, this rod being connected in articulated manner to a carriage 414*c*, the carriage 414*c* being guided by strips 414*x* of the processing plate 412. Here again, the guide strips 414*x* may be produced integrally with the processing plate 412. A spring 414*e* holds the cam follower roller 414*b* in engagement with the guide cam 424.

Figure 6:
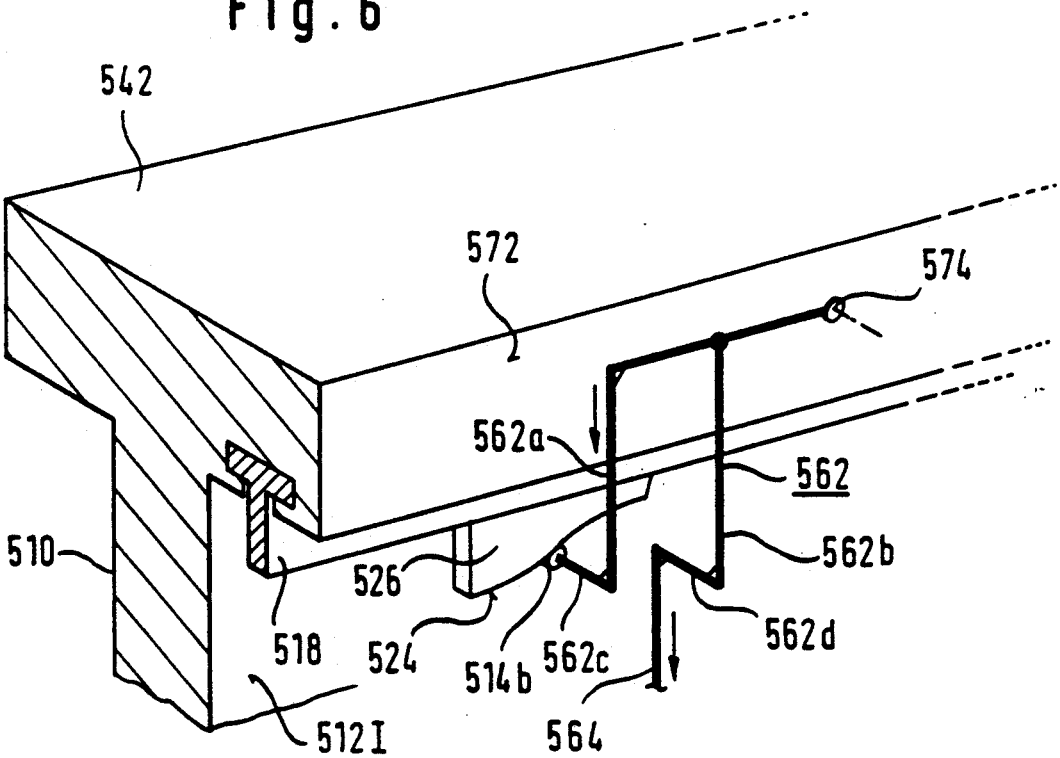
FIG. 6 a variant of FIG. 5.

In FIG. 6 is shown another form of embodiment of the pivoting lever, which is here referenced 562. Analogous components have the same references as in FIG. 5, but increased by 100. The lever 562 is in the present case formed as a single-sided lever, so that a downward movement of the lever arm 562*a* also causes a downward movement at the lever arm 562*b*, as indicated by the direction arrows in FIG. 6. The cranks 562*c* and 562*d* here again make possible a desired offset of the control cam elements and processing positions from the principal processing plane 512I.

Figure 7:
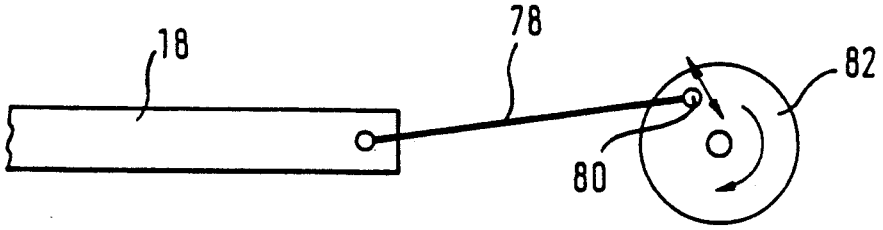
FIGS. 7, 8, 8*a* and 9 various drive possibilities for a drive rod.

In FIG. 7, an eccentric drive for a drive rod 18 is shown. The drive rod 18 is connected by a connecting rod 78 with an eccentric pin 80 of a drive wheel 82. For changing the stroke of the drive rod 18, the eccentric pin 80 is adjustable in the radial direction. The drive wheel 82 preferably revolves at constant but variable rotational speed.

Figure 8:
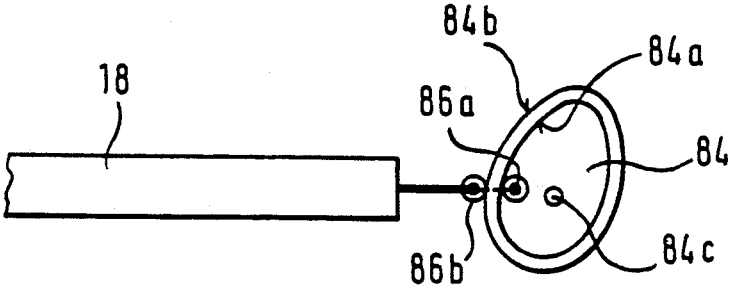

In FIG. 8, a cam drive for the drive rod 18 is shown. A cam drive disc 84 having a double cam 84*a*, 84*b*, acts upon a double cam follower having two cam follower rollers 86*a* and 86*b*, which is connected to the drive rod 18. In this form of embodiment, by appropriate selection of the shape of the cams 84*a* and 84*b*, different movement sequences of the drive rod 18 can be attained. Preferably, the cam disc 84 revolves at constant but variable rotational speed about the axis of rotation 84*c*.

Figure 8A:
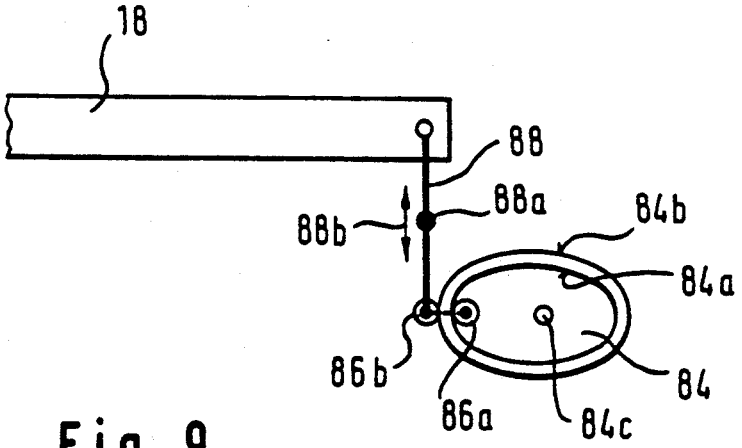

The embodiment of FIG. 8*a* corresponds in principle to that of FIG. 8, but between the cam follower 86*a*, 86*b* and the drive rod 18, a transmission gear in the form of a lever 88 is incorporated, the pivot point 88*a* of which is adjustable in the direction of arrow 88*b*, to vary the transmission ratio. In this manner, with an unchanged cam 84, the stroke of the drive rod 18 can be varied.

Figure 9:
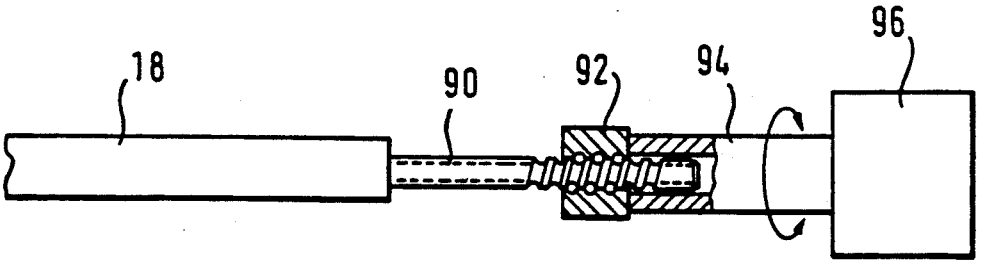

In FIG. 9, the drive rod 18 is provided with a threaded spindle 90, onto which a ball nut 92 can be screwed. The ball nut 92 is connected to the output shaft 94 of a motor 96, which is reversingly driven. In particular, the motor may be a programme-controlled motor, of which the rotational direction, angular position and angular velocity can be varied according to the programme. In this way, the movement sequence of the drive rod 18 can be varied as desired by appropriate selection of programme and adjusted to the particular processing tasks.

Figure 10:
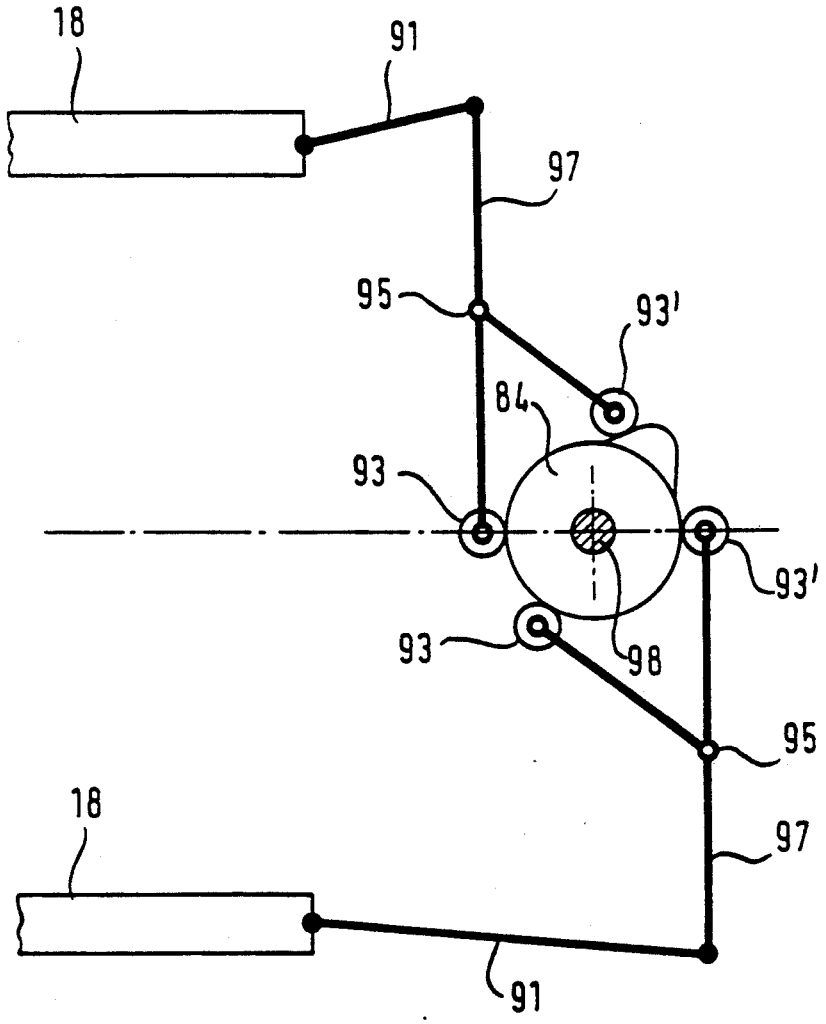
FIG. 10 the schematic arrangement of a drive common to several drive rods.

In FIG. 10, two drive rods 18 can be seen, which are driven by one common drive shaft 98. For each drive rod, there is a transmission lever 97, pivotally journalled at 95. Each transmission lever 97 has two cam followers 93, 93'. For each of the four cam followers 93 and 93' illustrated, a cam disc 84 is provided on the drive shaft 98, but only one cam disc 84 is illustrated here.

More than two drive rods could, of course, be driven from the common drive shaft 98. The drive connection between the transmission levers 97 and the drive rods 18 is provided via connecting rods 91.

Figure 11:
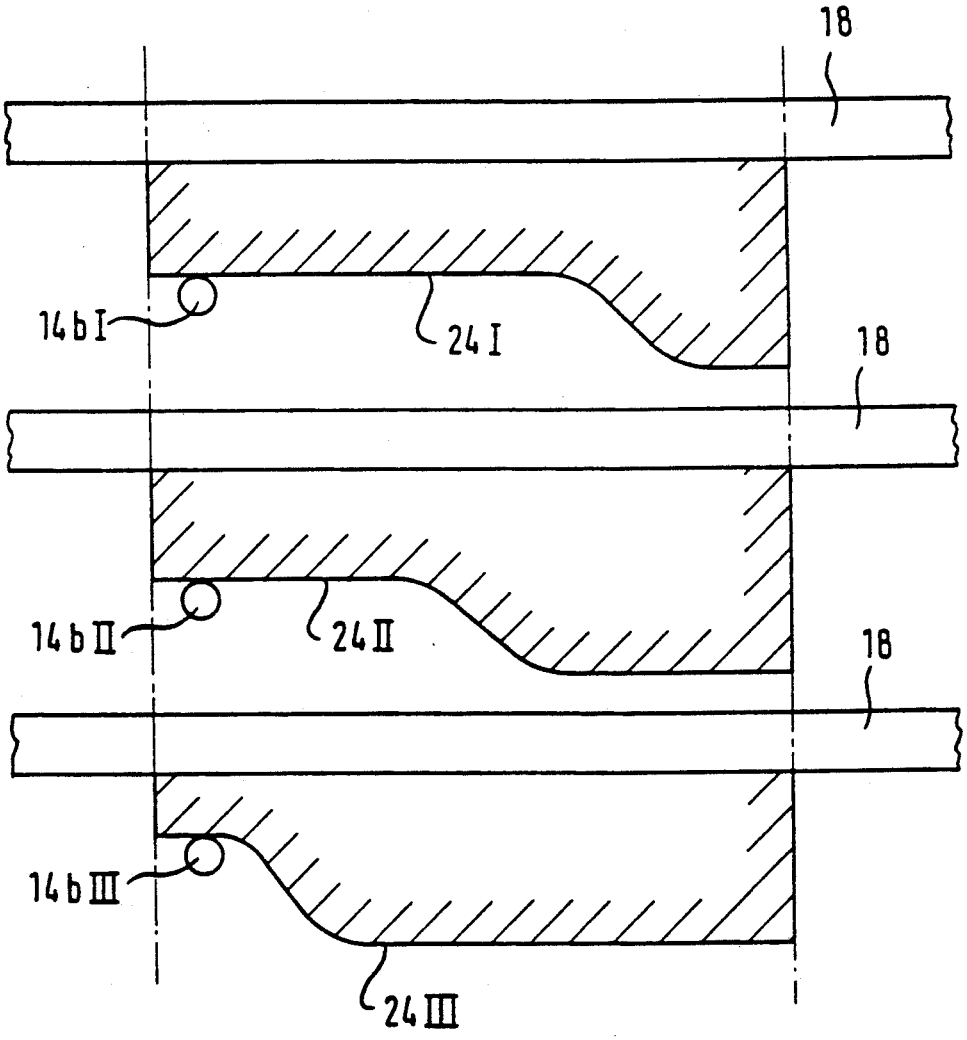
FIG. 11 a diagram for explaining an operating phase shift for several processing units.

In FIG. 11, the control cams 24I, 24II and 24III, mounted on one and the same drive rod 18, are illustrated one above another together with the associated cam followers 14*b*I, 14*b*II and 14*b*III. It will be seen that by the different shapes of the control cams 24I, 24II and 24III, different patterns and different phase displacements between the associated carriages can be produced. A horizontal shape of the individual cams means in each case stoppage of the associated carriage. It is only where the relevant cam shape departs from the horizontal, that a movement of the associated carriage takes place in each case. Therefore the stroke of the drive rod 18 can be adapted to the largest stroke of a processing unit that occurs and the smaller strokes of the other processing units can be obtained by giving to the cams associated with them a surface parallel to the drive rod 18 over a more or less large portion of their length.

Figure 12:
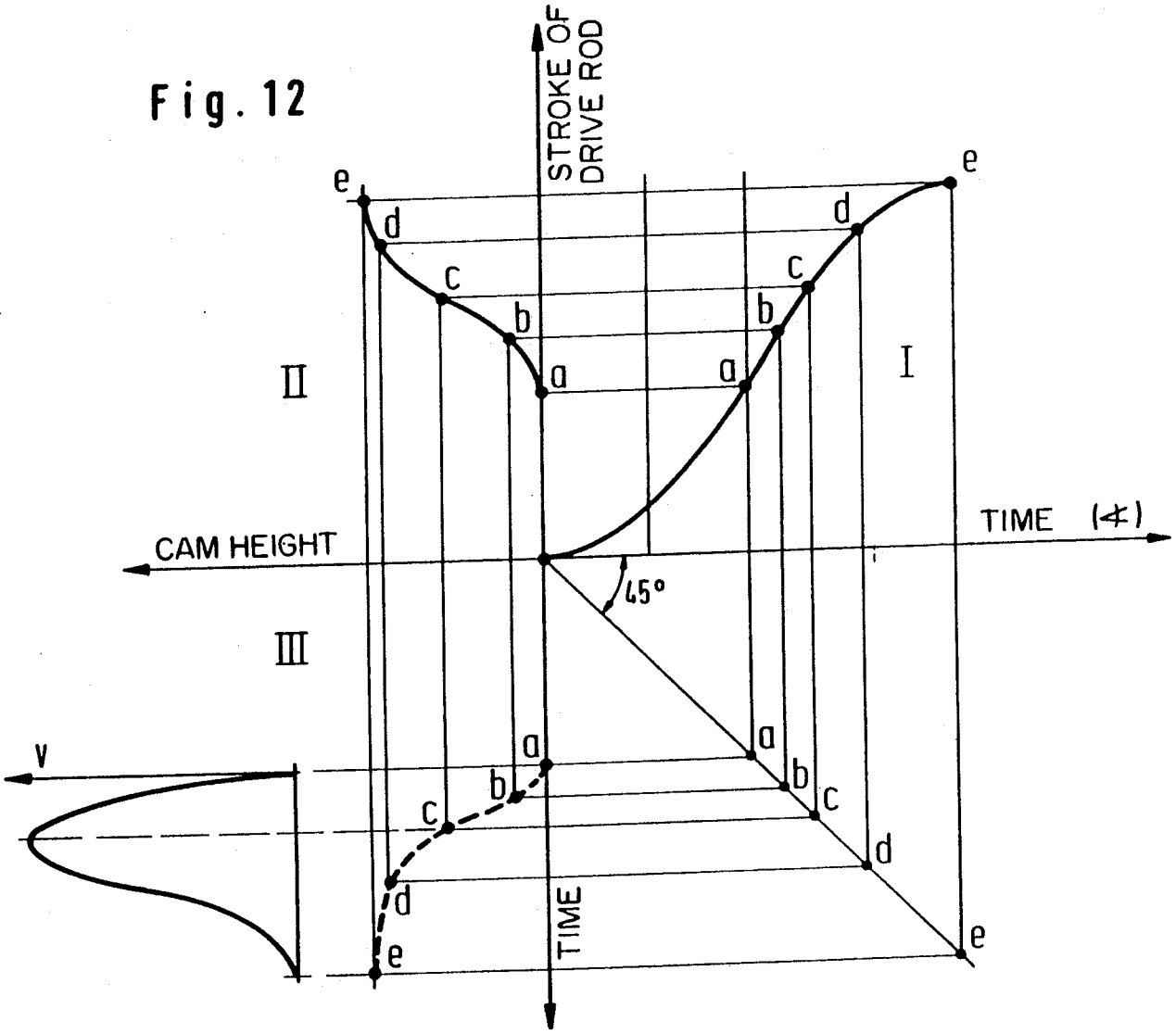
FIG. 12 a derivation of the movement sequence of a processing unit from the movement sequence of a drive rod and the form of a control cam.

FIG. 12 illustrates how, from the movement sequence of the drive rod 18 and the cam shape of a control cam 24, a desired movement sequence for a carriage 14*c* can be obtained. In quadrant I of FIG. 12, the movement pattern of the drive rod 18 is plotted against time (or in other words: against the angular position of a central control shaft of the machine). In quadrant II, the cam height of a cam 24 is plotted against the rod stroke. In quadrant III, the movement pattern of the carriage 14*c* is here again plotted against time or against the control angle of the central control shaft. The points a–e in the individual curves serve only for enabling corresponding points of the individual curves to be recognized in their mutual association. The following is of importance. By means of a simple sinusoidal form of the drive movement of the drive rod 18 (quadrant I) and by means of an also simple sinusoidal shape of the guide cam 24 (quadrant II), a movement curve for the slide 14*c* (quadrant III) can be generated, in which the movement sequence in the region d–e is extremely flat along the time axis. This means that the movement of the carriage in the region d–e is extremely slow. Such extremely slow movements can also be obtained in simple manner by carefully superposing the movement pattern of the movement curve of the drive rod 18 (quadrant I) and the shape of the cam curve 24 (quadrant II). In the additional curve of quadrant III, the velocity of the carriage 14*c* is also plotted against the time axis, and it can be seen that the velocity from point a onwards initially increases as far as point c and then decreases down to 0 between point c and point e. Such a velocity curve of a tool 14*d* is of great interest. In such a manner it can be achieved that the tool initially approaches the part of the workpiece to be processed at high velocity, but that then the actual machining or processing is carried out at a lower, decreasing velocity.

It is also possible to double the control cams for a specific processing unit symmetrically in such a manner that during one stroke of the drive rod two complete to-and-fro movements of a sliding carriage take place. In this way the movement frequency of a specific processing unit can be doubled by comparison with other processing units driven from the same drive rod, although only one single movement frequency of the drive rod is available.

Figure 13:
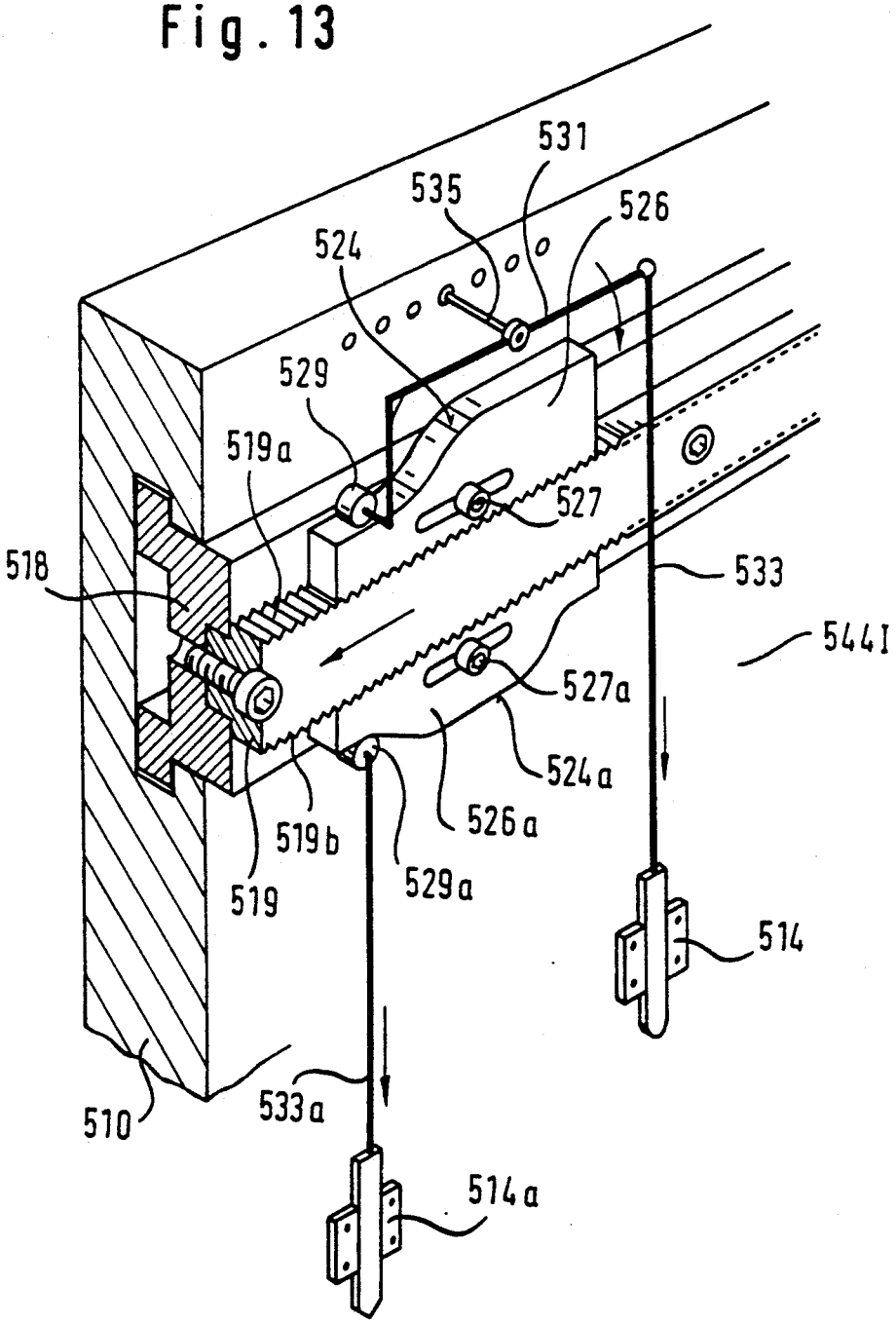
FIG. 13 a variant of FIG. 3, in which cam elements are mounted on a drive rod on two opposite side surfaces.

In FIG. 13, a partial view of a variant from FIG. 3 is shown. The machine frame in the present case is referenced 510 and can be constructed with a through passage corresponding to the passage 346 of FIG. 3. A principal processing plane 544I can also be seen in FIG. 13. A further principal processing plane corresponding to the processing plane 344II of FIG. 3 may be provided. The drive rod 518 is, in this case, guided in the surface of the machine frame 510 parallel to the principal processing plane 544. On the drive rod 518, a fine-toothed rack 519 having two sets of teeth 519*a* and 519*b*, facing away from each other, is mounted. On these sets of teeth 519*a* and 519*b*, control cam elements 526, provided with corresponding teeth, can be secured. The control cam elements 526 and 526*a* are secured by fixing screws 527, 527*a* respectively to the drive rod 518. The cam 524 of control cam element 526 is in engagement with a cam follower roller 529 of a two-armed lever 531, which acts upon a thrust rod 533. At the lower end of the thrust rod 533, a processing unit 514 can be coupled. A further cam follower 529*a* is in engagement with the cam 524*a* of the control cam element 526*a*. This cam follower 529*a* is drivingly connected via a thrust rod 533*a* with a further processing element 514*a*. It can be seen from FIG. 13 that the two thrust rods 533 and 533*a* are disposed in different planes in front of the machine frame 510, so that if desired the two processing elements 514 and 514*a* may also be disposed in different processing planes and if desired also one above the other. It is furthermore of importance that, at one and the same position along the drive rod 518, two cam followers 529 and 529*a* can be driven. The lever 531 is pivotally journalled by a bearing pin 535 in one of several bearing bores, available according to choice.

Figure 14:
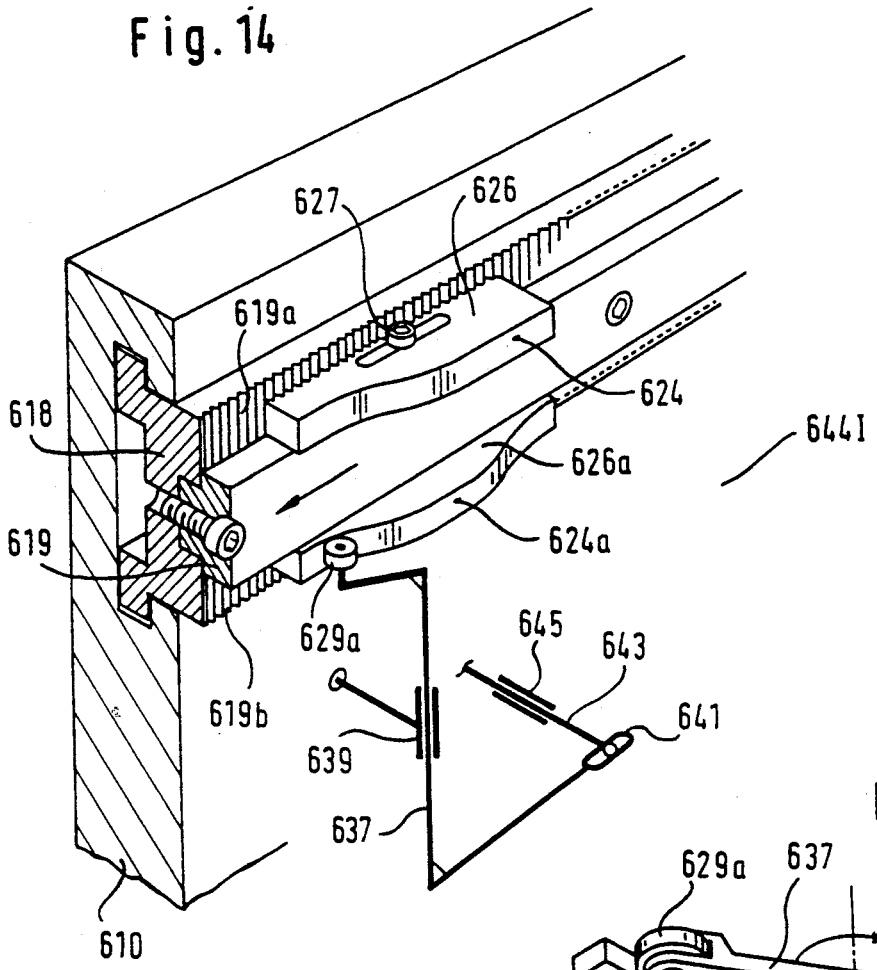
FIG. 14 a further variant to FIG. 3, in which cam elements are mounted on a drive rod spaced apart, the cams of which point away from the relevant processing plane.

In the embodiment according to FIG. 14, analogous parts have the same references as in the embodiment of FIG. 13, but increased by 100. The control cam elements 626 and 626*a* are here locked by sets of teeth 619*a* and 619*b* of the drive rod 618 and secured by screws 627 to the fixing rod 619. The cams 624 and 624*a* are both orientated away from the machine frame 610. The cam follower 629*a*, which is in engagement with the cam 624*a*, is mounted on a crank 637, which is pivotally journalled in a bearing 639 of the machine frame 610 and displaces a push rod 643 in a slide bearing 645 by means of a crankslide guide 641. On the push rod 643, a processing unit may be mounted, which will operate perpendicularly to the processing plane 644I. A conveying device may, however, also be mounted, which conveys, through a passage, partly machined workpieces from one principal processing plane to another principal processing plane. The cam 624 can serve for a similar drive.

Figure 15:
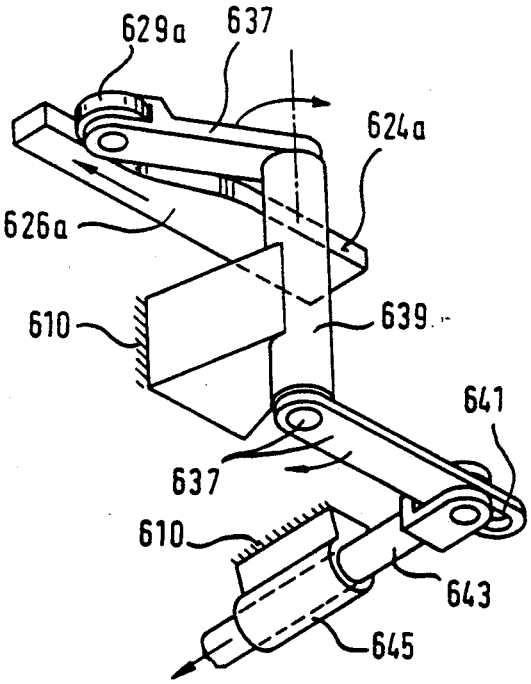
FIG. 15 a specific form of embodiment of the lever arrangement indicated schematically in FIG. 14.

Further details of the lever system of FIG. 14 can be seen from FIG. 15, where analogous parts bear the same references.

Figure 16:
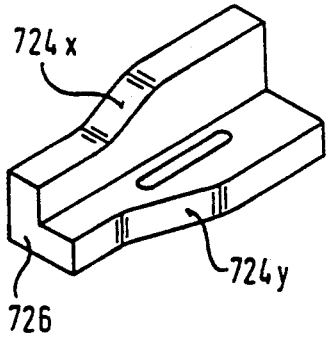
FIG. 16 a cam element having two cams lying in different planes for mounting in an assembly according to FIG. 14.

FIG. 16 shows that, on one and the same cam element 726, which can be used either in the arrangement of FIG. 13 or in the arrangement of FIG. 14, two control cams 724*x* and 724*y* can be provided, so that from this control cam element 726 both a push rod corresponding to the push rod 533*a* of FIG. 13 and also a crank corresponding to the crank 637 of FIG. 14 can be driven. It is possible to dispose two control cam elements 726 one above another, like the control cam elements 526 and 526*a* in FIG. 13 and the control cam elements 626 and 626*a* in FIG. 14.

Figure 17:
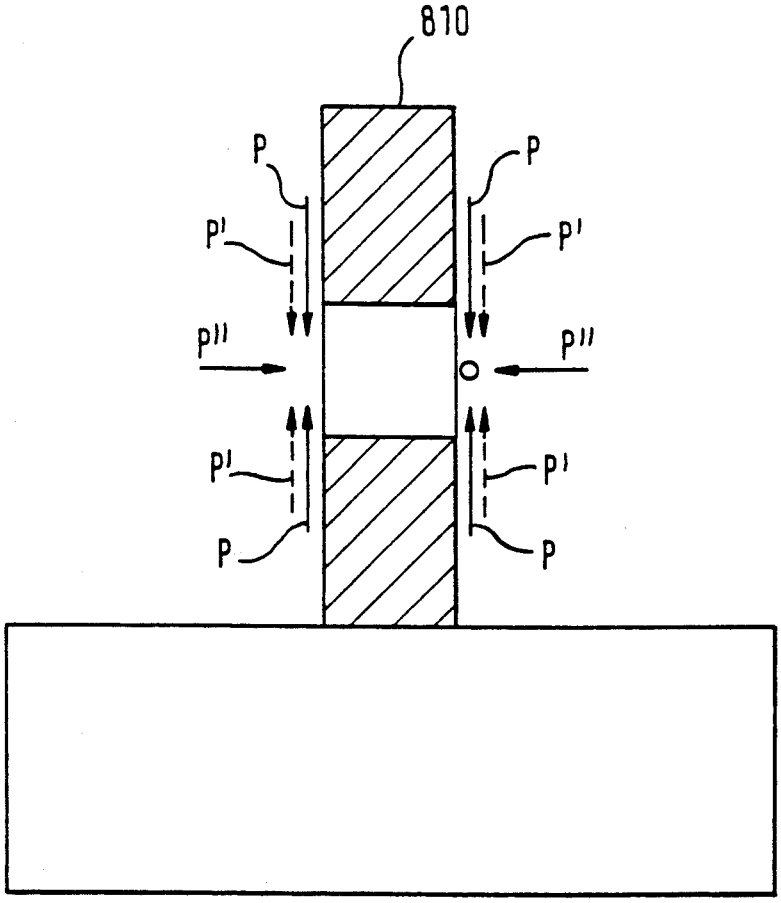
FIG. 17 a processing or machining diagram on a processing machine of this invention.

FIG. 17 shows schematically a machine frame 810 corresponding to the machine frames 510 and 610 of FIGS. 13 and 14. By the arrows P, various processing or machining directions of processing units are indicated, which can be driven, for example, from the cams 524*a* of FIG. 13. By the arrows P′, the processing directions of processing units are indicated which can be driven, for example, by the cams 524 of FIG. 13. The arrows P″ show the processing or conveying directions of processing or conveying devices which may be driven, for example, by the cams 624*a* of FIG. 14.

Figure 18:
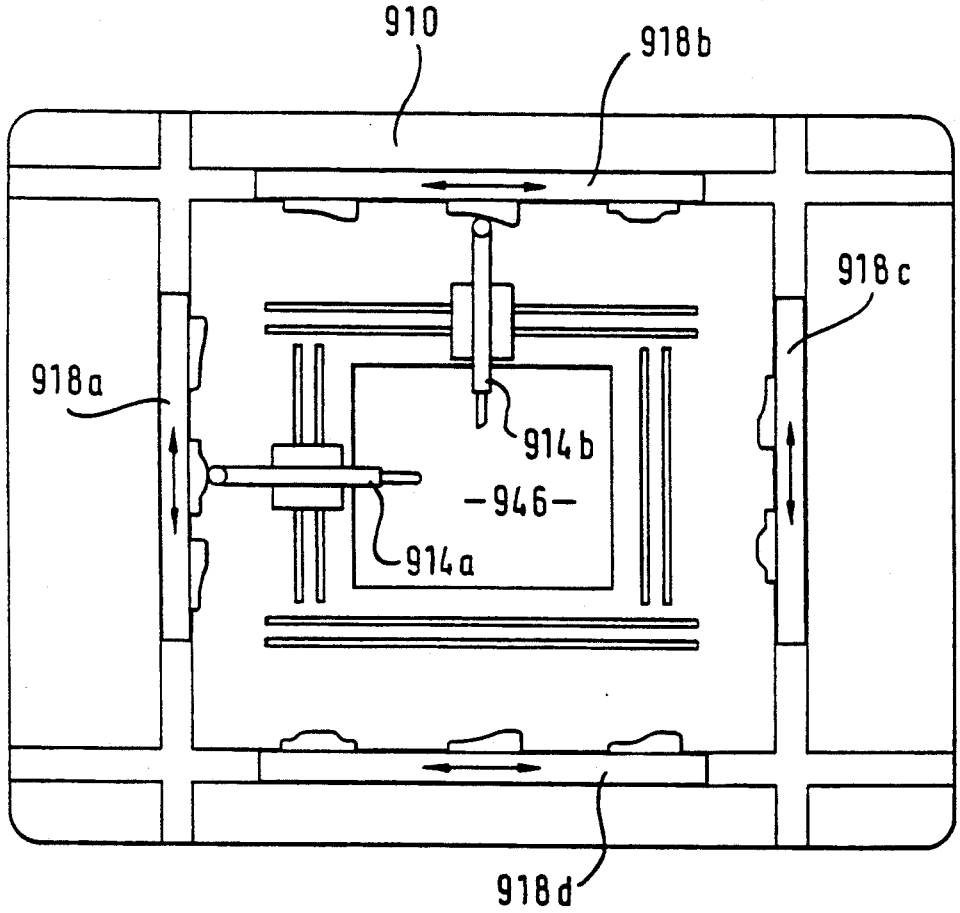
FIG. 18 a processing machine of this invention with drive rods orientated in a rectangular arrangement.

FIG. 18 shows a machine frame 910 having a passage 946, in which the processing zone is situated. In this figure, four drive rods 918*a*, 918*b*, 918*c*, 918*d* are each slidable in the direction of the double arrow associated with them around the passage 946. All these rods are equipped with cam elements and serve for driving processing units 914*a*, 914*b* etc.. All these processing units work towards the central processing zone 946. In this form of embodiment also, two processing planes can be disposed on the two sides of the machine frame 910, and connected together by the through passage 946. In the second processing plane, not illustrated, the same rod arrangement can be adopted as in FIG. 18.

Figure 19:
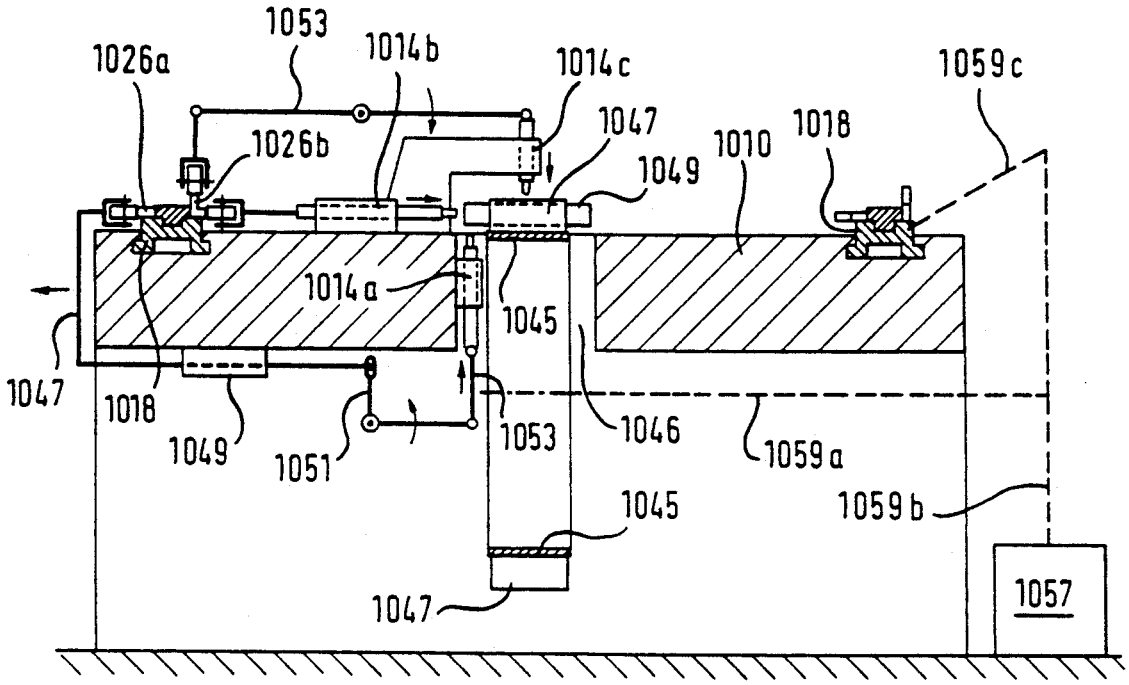
FIG. 19 a processing machine with horizontal principal processing plane and a workpiece conveying device.

In FIG. 19, a typical assembly machine is illustrated. The machine frame is here referenced 1010. In the centre of the machine frame 1010, a long slit 1046, orientated perpendicularly to the plane of the drawing, can be seen. Inside this slit runs a conveyor belt 1045, which carries workpiece carriers 1047 for workpieces 1049. The workpieces 1049 are conveyed intermittently by the conveyor belt 1045 perpendicularly to the plane of the drawing from station to station. In the machine frame 1010, for example, two drive rods 1018 are guided and driven perpendicularly to the plane of the drawing. Various processing tools are driven by the drive rods 1018. We will consider only the left half of FIG. 19. On the drive rod 1018, a control cam element 1026*a*, corresponding to the control cam element 526 of FIG. 13, is seated. From this control cam element 1026*a*, a sliding stirrup 1047 is displaced in a guide 1049, and this stirrup drives, via a cranked lever 1051 and a push rod 1053, a processing unit 1014*a* for acting on the workpiece 1049.

On the drive rod 1018 there is also seated a control cam element 1026*b*, which is constructed correspondingly to the control cam element 726 of FIG. 16. This cam element 1026*b* drives, by a first control cam, the processing unit 1014*b*, which also acts upon the workpiece 1049. A second control cam of the control cam element 1026*b* drives, via a two-armed lever 1053, a further processing unit 1014*c*. Corresponding processing units can be driven from the drive rod 1018, at the right in FIG. 19. One drive unit 1057 is indicated schematically, which synchronously drives both the conveyor belt and also the drive rods 1018 via schematically indicated transmission means 1059*a*, 1059*b* and 1059*c*.

Figure 20:
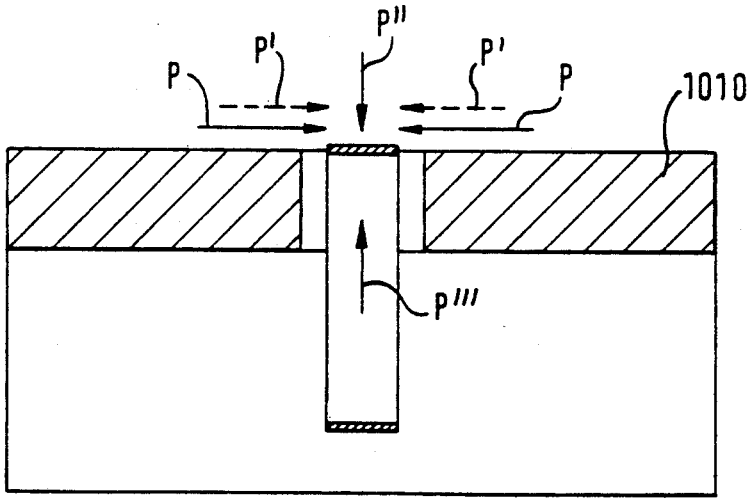
FIG. 20 a processing diagram for FIG. 19.

In FIG. 20, the arrangement of FIG. 19 is shown schematically. The arrows P represent the working movement of the processing units 1014*b*. The arrows P' represent the processing movement of processing units, not illustrated, in a higher processing plane, the latter processing units being perhaps driven by a drive rod which has a second control surface, as illustrated in FIG. 3 at 318*b*. The arrow P'' represents the working movement of processing unit 1014*c* of FIG. 19. The arrow P''' represents the working movement of processing unit 1014*a* of FIG. 19, although a change has been made with respect to FIG. 19 in that the processing unit 1014*a* has been shifted to be inside the conveyor belt loop 1045, so that the tool of the processing unit 1014*a* reaches the workpiece 1049 through openings in the conveyor belt.

With an arrangement according to FIGS. 19 and 20, complicated parts can be machined and assembled from individual elements, it being of course possible for additional feed means to be provided for the feeding of individual elements.

Figure 21:
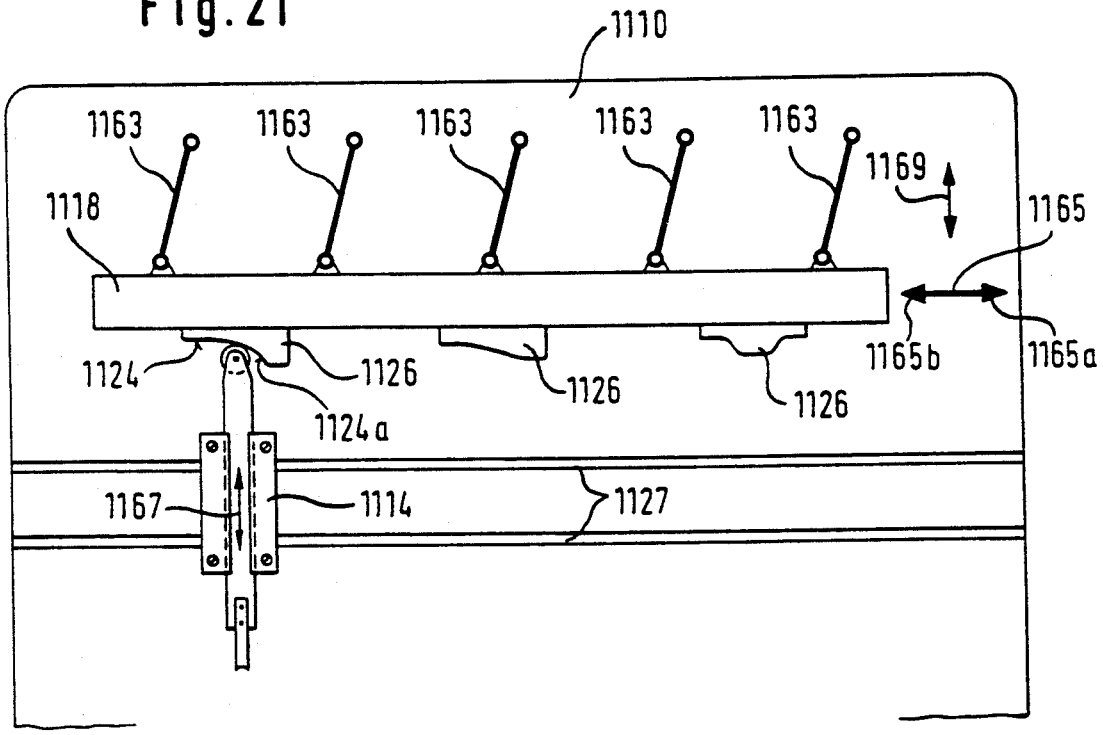
FIG. 21 a form of embodiment with modified drive rod guide.

In FIG. 21, a variant from FIG. 1 is illustrated. The drive rod 1118 is, in this case, not guided in a guide groove but is guided by a plurality of guide links 1163, which are articulated at their upper ends to the machine frame 1110 and at their lower ends to the drive rod 1118. The drive rod 1118 is reciprocatingly driven in the direction of the double arrow 1165 by drive means, such as those illustrated in FIGS. 7 to 10. On the drive rod 1118, the control cam elements 1126 with control cams 1124 are mounted, generally as described for FIGS. 13 or 14. The control cams 1124 act upon the processing units 1114, which are fixed in grooves 1127 and undergo an up and down tool movement in the direction of arrow 1167.

In this form of embodiment, the longitudinal motion 1165 of the drive rod 1118 has a small vertical motion 1169 superimposed upon it. This vertical motion can be taken into account by the forming of the control cams 1124 so that the processing units 1114 again execute the correct movement sequence.

Let us now give consideration to a possibility of operation which can also be realized with the form of embodiment of FIG. 1: the drive for the drive rod 1118 can be so arranged by a drive apparatus as shown in FIGS. 8, 8*a*, 9 or 10, that the movement in the direction of arrow 1165*a* takes place at a higher movement velocity of the rod 1118 than in the direction of arrow 1165*b*. This means, in respect of the form of the cam 1124 of FIG. 21, that the downwardly directed working motion of the machining unit 1114 takes place more slowly than the upwardly directed return motion. To express it another way: for the working movement of the processing unit 1114, a larger proportion is available of the total time available for the outward and return stroke of the processing unit 1114. This may be advantageous because the necessary working stroke of the processing unit then takes place more slowly. The slower movement of the drive rod 1118*a* in the direction of arrow 1165*b* is particularly advantageous when very steep flank zones are present on the control cam 1124, as at 1124*a*.

Figure 22:
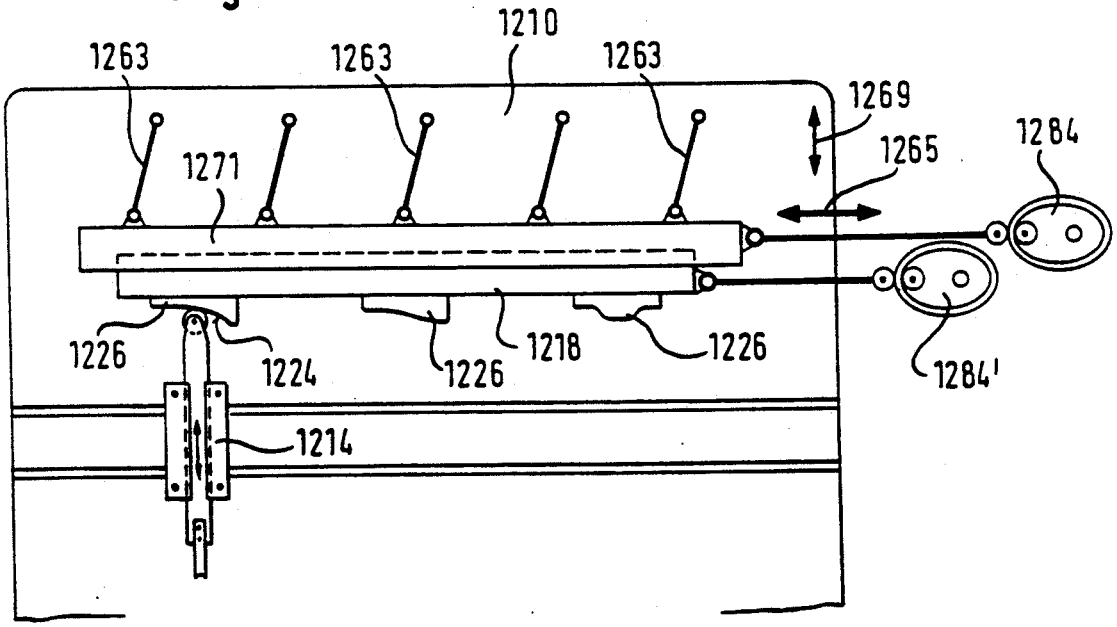
FIG. 22 a form of embodiment with a further modified drive rod guide.

In FIG. 22, a further variant of FIG. 1 is illustrated. On the machine frame 1210, a guide rail 1271 is guided by links 1263 in such a manner that once again a horizontal movement 1265 and a small vertical movement 1269 of the guide rail 1271 results, if the guide rail 1271 is driven by a cam disc 1284 according to FIG. 8. In the guide rail 1271, a drive rod 1218 having control cam elements 1226 is driven by a cam disc drive 1284'. The control cam elements 1226 act with their cams 1224 on the processing unit 1214 in the manner already described. The fundamental movement of the drive rod 1218 is derived from the cam disc drive 1284'. By the cam disc drive 1284, the upward movement of the guide rail 1271 in the direction of arrow 1269 can be initiated each time when the drive rod 1218 has reached its limiting position, in which the processing unit 1214 has completed its downward movement. At this instant, the guide rail 1271 is then lifted upwards, so that the processing units, without loosing engagement with the control cams 1224, immediately turn back upwards out of their lowest working position. When the drive rod 1218 is pulled back in the direction of arrow 1265 again into a position in which the downward movement of the processing units 1214 can again commence, then the guide rail 1271 is again lowered by the cam disc drive 1284, using the links 1263. This method of operation can be advantageous especially when the working stroke of the drive rod 1218 takes place faster than the return stroke.

Figure 23:
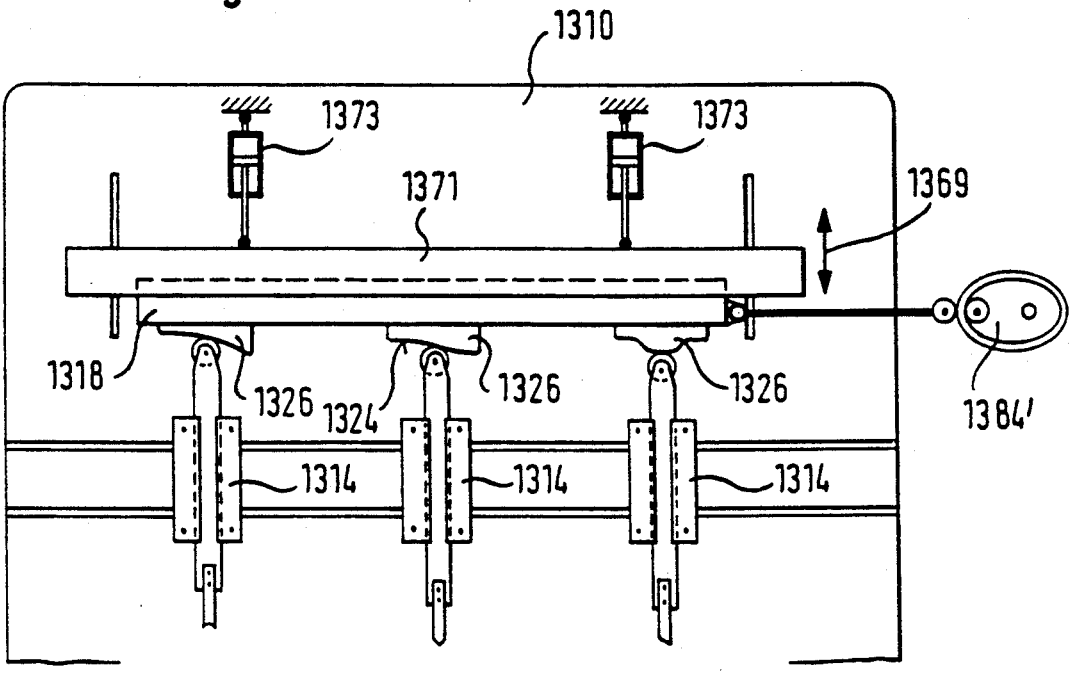
FIG. 23 a form of embodiment with a further modified drive rod guide.

The method of functioning according to FIG. 22 can be realized also by a variant according to FIG. 23. Here, the guide rail 1371 is immovable in a horizontal direction and adjustable in a vertical direction by pneumatic or hydraulic cylinders 1373. The upward and downward movement 1369 is therefore produced by the cylinders 1373. In other respects, the embodiment of FIG. 23 corresponds to that of FIG. 22, analogous parts having the same references, but increased in each case by 100.

Figure 24:
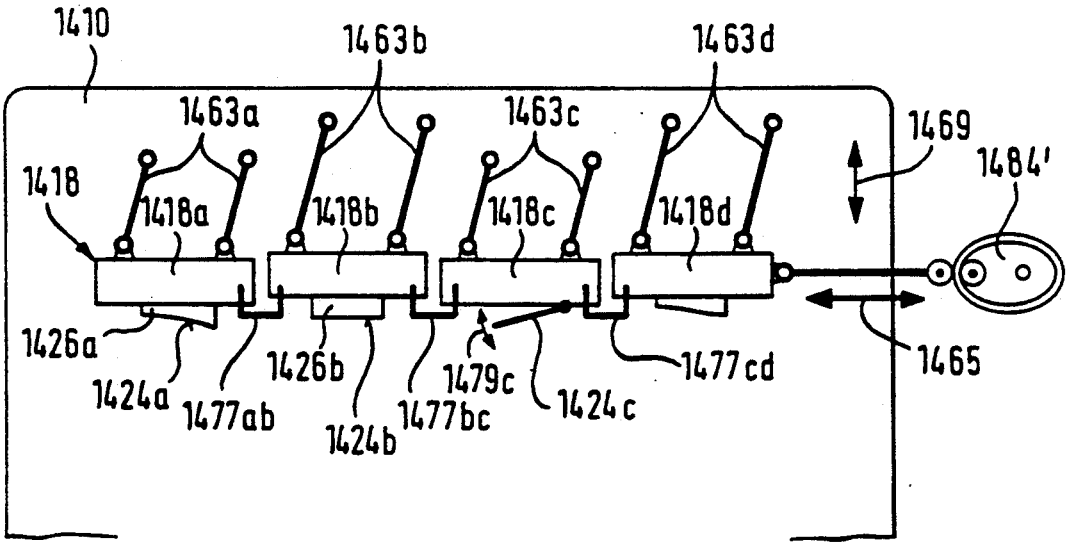
FIG. 24 a form of embodiment with a further modified drive rod guide.

In FIG. 24 it is shown that the drive rod 1418 can be composed of a plurality of drive rod portions 1418*a*, 1418*b*, 1418*c* and 1418*d*. The drive rod portions 1418*a* and 1418*d* are each guided by a pair of links 1463*a*, 1463*b*, 1463*c* and 1463*d* respectively. The individual portions 1418*a*–1418*d* are rigidly connected together by transmission elements 1477*ab*, 1477*bc* and 1477*cd*, in the direction of arrow 1465. The transmission elements make possible, however, a relative movement of the drive rod portions 1418*a*–1418*d* in the direction of arrow 1469. According to the different lengths of the links 1463*a*–1463*d*, the drive rod portions 1418*a*–1418*d* execute strokes of different lengths in the direction of arrow 1469 in a movement cycle of the cam disc drive 1484'. On the drive rod portion 1418*b*, a control cam element 1426*b* having a cam 1424*b* of straight and horizontal form is mounted. In this case, the working movement of the associated processing unit, not indicated, is determined solely by the vertical movement 1469 of the drive rod portion 1418*b*, the stroke of which is determined by the length of the guide links 1463*b*.

On the drive rod portion 1418*a*, a cam element 1426*a* having a conventional cam 1424*a* is mounted, the cam 1424*a* being so chosen that its shape, taking into account the guide links 1463*a*, gives the desired movement pattern of the associated processing unit (not shown).

On the drive rod portion 1418*c*, a control cam 1424*c* is mounted, the inclination of which relative to the longitudinal direction of the drive rod portion 1418*c* can be varied according to arrow 1479*c*. In this case, the desired movement pattern of the associated processing unit (not shown) can be adjusted by the choice of the angle of slope of the control cam 1424*c*, allowing for the length of the guide links 1463*c*.

The subdividing of the drive rod into individual portions may also be advantageous in the form of embodiment according to FIG. 1, when the drive rod as a whole becomes very long and therefore is difficult to machine. In this case, the individual drive rod portions, in the embodiment of FIG. 1 also, may be connected together by transmission elements corresponding to transmission elements 1477*ab*, 1477*bc* and 1477*cd*.

While specific embodiments of the invention have been shown and described in detail to illustrate the application of the inventive principles, it will be understood that the invention may be embodied otherwise without departing from such principles.

The reference numerals in the claims are only used for facilitating the understanding and are by no means restrictive.

We claim:

1. A processing machine comprising:

a machine frame (10);

means for defining a plurality of processing locations on the machine frame (10);

a processing unit (14) mounted on the machine frame at each of selected ones of said plurality of processing locations, each of said processing units so mounted having at least one moving part (14*c*);

drive means supported by the machine frame (10) and common to one or more of said selected processing locations for driving said at least one moving part (14*c*) of said processing units (14) mounted at said one or more selected processing locations;

said drive means comprising at least one drive rod unit (18) associated with said one or more selected processing locations and guided substantially linearly on the machine frame (10) in a guidance direction and reciprocating in an oscillating manner in said guidance direction, said drive rod unit (18) being provided with a control means (24, 26) allocated to each of said one or more selected processing locations to define respective pairs of a processing unit (14) and a control means (24, 26), each of said respective pairs of processing units-control means including a control cam element (26) and a cam follower (14*h*) engageable therewith for driving the respective processing unit (14);

said control cam element (26) being movable with one of said drive rod unit (18) and said at least one moving part (14*c*) of the respective processing unit (14) and said cam follower (14*h*) being moveable with the other one of said drive rod unit (18) and said at least one moving part (14*c*) of the respective processing unit (14).

2. A processing machine according to claim 1 wherein said drive means includes means for changing at least one of the oscillation frequency, the oscillation stroke and the oscillation shape of said drive rod unit (18).

3. A processing machine according to claim 1 or claim 2 wherein said drive means includes an eccentric drive (82, 80, 78) for driving said drive rod unit (18).

4. A processing machine according to claim 1 wherein said drive means includes a cam drive (84, 86*a*, 86*b*) for driving said drive rod unit (18).

5. A processing machine according to claim 1 wherein said drive means includes a worm drive (92, 90), having a reversing motor (96), for driving said drive rod unit (18).

6. A processing machine according to claim 5 wherein said reversing drive motor (96) is programme-controlled to provide at least one of a predetermined angular position, a predetermined angular velocity, and a predetermined rotational speed of said motor.

7. A processing machine according to claim 1 wherein said drive means includes a transmission gear (88), having a variable transmission ratio, for driving said drive rod unit (18).

8. A processing machine according to claim 7 wherein said transmission gear (88) is a lever gear (88) having a variable transmission ratio.

9. A processing machine according to claim 1 further comprising one or more auxiliary devices (38) supported by said machine frame, and means for driving respective ones of said auxiliary devices from said drive rod (18) via a control cam (24*a*) carried by one of said respective auxiliary device and said drive rod unit (18) and a cam follower carried by the other of said respective auxiliary device and said drive rod unit (18).

10. A processing machine according to claim 9 wherein said drive means for at least one of said auxiliary devices (38) is a drive for a material feed apparatus (38).

11. A processing machine according to claim 9 wherein said drive means for at least one of said auxiliary devices (38) is a drive for a workpiece conveying apparatus (38).

12. A processing machine according to claim 1 wherein said drive means comprises a plurality of said drive rod units (18) and a common drive shaft (98) for driving said plurality of drive rod units (18).

13. A processing machine according to claim 1 wherein on a principal working plane of said machine frame (10), two said drive rod units (18), substantially parallel to each other, are mounted, between said two drive rod units (18) a workpiece processing zone (16) is provided, and a plurality of said processing units (14) are associated with each drive rod unit (18), said at least one moving part (14*c*) of each processing unit being movable with respect to said processing zone (16).

14. A processing machine according to claim 1 wherein on said machine frame (310) two processing planes (312I, 312II), spaced apart and substantially parallel to each other, are formed, and wherein at least one said drive rod unit (318) is associated with each of said processing planes (312I, 312II), and wherein said machine frame (310) possesses a workpiece passage (346) connecting said two processing planes (312I, 312II).

15. A processing machine according to claim 14, wherein in said workpiece passage (346), transverse conveying means (348, 352) are provided for transferring workpieces from one to the other of said two processing planes.

16. A processing machine according to claim 15, further comprising means for driving said transverse conveying means (348, 352).

17. A processing machine according to claim 1 wherein in front of a processing plane (312I), in a direction perpendicular to said processing plane (312I), two or more of said drive rod units (318*a*, 318*b*) are disposed alongside and parallel to one another.

18. A processing machine according to claim 1 wherein in front of a processing plane (312I) of said machine frame (310), said drive rod unit (318) is disposed and possesses one or more longitudinal zones of or said control cam elements (326), said longitudinal zones lying alongside one another and being spaced in a direction perpendicular to said processing plane (312I).

19. A processing machine according to claim 1 wherein said drive rod unit (318) is disposed on a beam component (344I) of said machine frame (310) which is cantilevered over a processing plane (312I) of said machine frame (310).

20. A processing machine according to claim 19 wherein one or more transmission levers (462) are pivotally mounted on a front face (472) of said beam component (444I) substantially parallel to said processing plane (412I), each said transmission lever being engageable with said control cam (424) on one of said drive rod units (418) and acting upon said moving part (464) of said respective processing unit.

21. A processing machine according to claim 1 wherein said at least one moving part of each said processing unit (14) is formed by a carriage (14*c*), which is guided on a slide guide (14*b*) located on said processing unit (14) linearly, and wherein said carriage (14*c*) is drivingly connected with a pivoting lever (14*f*), which is pivotally journalled on one of said slide guide (14*b*) and said machine frame (10) and which receives a pivoting movement from said drive rod unit (18) and transmits it to said carriage (14*c*).

22. A processing machine according to claim 21 wherein said pivoting lever (14*f*) extends substantially transversely to a movement direction of said carriage (14*c*) and parallel to a movement direction of said drive rod unit (18).

23. A processing machine according to claim 22 wherein a first engagement position (14*h*, 24) between said pivoting lever (14*f*) and said drive rod unit (18) and a second engagement position (14*i*) between said pivoting lever (14*f*) and said carriage (14*c*) lie in an alignment with each other substantially parallel to said direction of movement of said carriage (14*c*).

24. A processing machine according to claim 23, further comprising:

spring means (14*e*) interposed between said pivoting lever (14*f*) and said carriage (14*c*) for urging said pivoting lever (14*f*) and said carriage (14*c*) into mutual engagement at said second position (14*f*, 14*i*);

sensor means (14*p*) carried by at least one of said pivoting lever (14*f*) and said carriage (14*c*) for detecting any separation between said pivoting lever (14*f*) and said carriage (14*c*) and, if such a separation is detected, for generating a shutdown signal for said processing machine.

25. A processing machine according to claim 1 wherein at least one control cam element (26) possesses a rectilinear control cam, and wherein an angular setting of said control cam relative to a direction of oscillation of said drive rod unit (18) can be varied and fixed.

26. A processing machine according to claim 1 wherein said drive rod unit (18), together with said control cam elements (26) mounted thereon, is replaceable as a whole, and said processing location defining means includes position indication means (30) provided on said processing machine for allowing a processing unit (14), which has been removed from a once adjusted position, to be mounted at a later time again in said adjusted position on said processing machine.

27. A processing machine according to claim 1 wherein said drive rod unit (18) is provided, at one end, with a push-and-pull drive, and wherein said processing units (14) and said control cam elements (26) associated with them are arranged so that the largest processing forces of said processing units (14) occur in a pulling phase of said drive rod unit (18).

28. A processing machine according to claim 1 wherein a direction of working of a moving part (14*c*) of a processing unit (14) is variable with respect to a preferred direction substantially perpendicular to a direction of oscillation of the drive rod unit (18).

29. A processing machine according to claim 1 wherein said drive means includes a plurality of said drive rod units (18) and means for driving different ones of said drive rod units (18) with at least one of a different oscillation stroke and a different oscillation frequency.

30. A processing machine according to claim 1 wherein said drive rod unit (1118) is driven more slowly in a movement direction (1165*b*) that corresponds to a working stroke of said associated processing units (1114) than in a movement direction (1165*a*) that corresponds to a return stroke of said associated processing units (1114).

31. A processing machine according to claim 1 wherein said drive rod unit (1418) comprises a plurality of drive rod portions (1418*a*–1418*d*), substantially aligned with one another, which are connected together in a longitudinal direction of said drive rod units for common movement.

32. A processing machine according to claim 31 further comprising guide link means (1463*a*) supported on said machine frame (10) for guiding at least one portion (1418*a*) of said drive rod unit (1418) in the manner of an articulated parallelogram.

33. A processing machine according to claim 32, wherein a working movement of a processing unit (1418) is derived at least partly from a movement (1469) of a drive rod portion (1418*b*), oriented transversely to the guidance direction of the drive rod unit (1418), said transversely oriented movement (1469) being obtained by guidance of said drive rod portion (1418*b*) by means of said guide link means (1463*b*).

34. A processing machine according to claim 1 further comprising means for adjustably supporting said drive rod unit (1218) in a direction transverse to its guidance direction and, during a movement phase parallel to its guidance direction which corresponds to a return stroke of said associated processing units (1214), for retracting said drive rod unit (1218) from said processing units (1214).

35. A processing machine according to claim 1 wherein one or more of said processing units (1014*a*–1014*c*) and said associated drive rod unit (1018) are disposed in a horizontal processing plane.

36. A processing machine according to claim 1 wherein a conveying means (1045) is provided on said machine frame (1010) for conveying workpieces (1049) that are to be processed step-by-step through different processing stations.

37. A processing machine according to claim 1 wherein at least one of said control cam element (26) and said cam follower (14*h*) is adjustable along the associated drive rod unit (18, 218) and the processing units (14) are adjustable on the machine frame (10) in at least one of a direction parallel to the guidance direction of said associated drive rod unit (18) and a direction transverse to the guidance direction of said associated drive rod unit (18).

38. A processing machine according to claim 1 wherein said processing machine is an automatic punching and bending machine.

39. A processing machine according to claim 1 wherein said processing machine is an assembling machine.

40. A processing machine according to claim 1, wherein said control cam element (26) comprises a cam (24) for engaging said cam follower (14*h*), said cam (24) being shaped to provide, in coaction with the movement of said drive rod unit (18), a predetermined pattern of movement of said at least one moving part (14*c*) of a processing unit (14).

41. A processing machine according to claim 1 wherein at least one processing plane is formed on said machine frame (910), and a plurality of said drive rod units (918*a*, 918*b*, 918*c*, 918*d*) are arranged in said plane in a polygonal configuration to surround and define therebetween a processing zone (946) on said machine frame (910).

42. A processing machine according to claim 41, wherein said plurality of said drive rod units (918*a*, 918*b*, 918*c*, 918*d*) are arranged in a generally rectangular configuration on said machine frame (910).

* * * * *

UNITED STATES PATENT AND TRADEMARK OFFICE

CERTIFICATE OF CORRECTION

PATENT NO. : 5,186,037

DATED : February 16, 1993

INVENTOR(S) : Otto Bihler

It is certified that error appears in the above-identified patent and that said Letters Patent is hereby corrected as shown below:

Col. 9, line 9, "mvoes" should read --moves--;
Col. 18, bridging lines 62-63, "of or" should read --for--.

Signed and Sealed this

Twenty-eighth Day of December, 1993

*Attest:*

Bruce Lehman

BRUCE LEHMAN

*Attesting Officer*

*Commissioner of Patents and Trademarks*